US008246442B1

(12) United States Patent
Barrie

(10) Patent No.: US 8,246,442 B1
(45) Date of Patent: Aug. 21, 2012

(54) DYNAMIC ASSIGNMENT OF PAY LINES IN A GAME OF CHANCE

(76) Inventor: Robert P Barrie, Merrimack, NH (US)

( * ) Notice: Subject to any disclaimer, the term of this patent is extended or adjusted under 35 U.S.C. 154(b) by 287 days.

(21) Appl. No.: 12/652,945

(22) Filed: Jan. 6, 2010

Related U.S. Application Data

(62) Division of application No. 11/294,124, filed on Dec. 5, 2005, now Pat. No. 7,972,207.

(51) Int. Cl.
*A63F 9/24* (2006.01)

(52) U.S. Cl. ..... 463/20; 436/16; 436/25; 436/1; 436/13; 273/138.1; 273/292

(58) Field of Classification Search ..... 463/16, 463/20, 25, 1, 13; 273/138.1, 292
See application file for complete search history.

(56) References Cited

U.S. PATENT DOCUMENTS

| | | | | |
|---|---|---|---|---|
| 6,604,999 | B2 * | 8/2003 | Ainsworth | 463/20 |
| 6,869,357 | B2 * | 3/2005 | Adams et al. | 463/16 |
| 7,494,413 | B2 * | 2/2009 | Singer et al. | 463/20 |
| 7,601,062 | B2 * | 10/2009 | Cole et al. | 463/20 |
| 2002/0055382 | A1 * | 5/2002 | Meyer | 463/20 |
| 2003/0045345 | A1 * | 3/2003 | Berman | 463/20 |
| 2006/0079316 | A1 * | 4/2006 | Flemming et al. | 463/25 |

* cited by examiner

*Primary Examiner* — David L Lewis
*Assistant Examiner* — Chase Leichliter
(74) *Attorney, Agent, or Firm* — Joseph E. Funk

(57) ABSTRACT

A game of chance is disclosed that looks like a multi-line gaming machine having a matrix of rows and columns of positions for displaying slot symbols or cards to a player. A player wagers to play one or more games but the actual pay lines are dynamically determined by events that occur during the course of game play, not before. Per the teaching of the invention a number of bonus pay lines and their routing are dynamically determined during the course of game play of slots or cards dependent on choices made by a player during game play.

7 Claims, 13 Drawing Sheets

| | Bonus A Pay Lines | Bonus B Pay Lines | Bonus Hit | Played Pay Lines | Total Pay Lines | |
|---|---|---|---|---|---|---|
| Round 1 | 2 | 2 | 0 | 6 | 6 | Fig. 20 |
| Round 2 | 4 | 4 | B | 6 | 10 | Fig. 21 |
| Round 3 | 6 | 2 | 0 | 6 | 6 | Fig. 22 |
| Round 4 | 8 | 4 | A | 6 | 14 | Fig. 23 |
| Round 5 | 2 | 6 | 0 | 6 | 6 | Fig. 20 |

| | Bonus A Pay Lines | Bonus B Pay Lines | Bonus C Pay Lines | Bonus Hit | Played Pay Lines | Total Pay Lines |
|---|---|---|---|---|---|---|
| Round 1 | 2 | 2 | 2 | 0 | 6 | 6 |
| Round 2 | 4 | 4 | 4 | 0 | 6 | 6 |
| Round 3 | 6 | 6 | 6 | 0 | 6 | 6 |
| Round 4 | 8 | 8 | 8 | B | 6 | 14 |
| Round 5 | 10 | 2 | 10 | 0 | 6 | 6 |
| Round 6 | 12 | 4 | 12 | A | 6 | 18 |
| Round 7 | 2 | 6 | 14 | 0 | 6 | 6 |
| Round 8 | 4 | 8 | 16 | 0 | 6 | 6 |
| Round 9 | 6 | 10 | 18 | C | 6 | 24 |
| Round 10 | 8 | 12 | 2 | 0 | 6 | 6 |

Figure 25

DYNAMIC ASSIGNMENT OF PAY LINES IN A GAME OF CHANCE

CROSS REFERENCE TO RELATED APPLICATION

The present invention is a divisional application of U.S. patent application Ser. No. 11/294,124 filed Dec. 5, 2005 now U.S. Pat. No. 7,972,207, entitled "Dynamic Assignment Of Pay Lines In A Game Of Chance", the entirety of which is incorporated herein by reference, and this divisional application is entitled to the priority of the earlier filing date.

FIELD OF THE INVENTION

The present invention relates primarily to games of chance played on gaming machines, such as electronic video poker games and slot machines. More particularly, the invention relates to pay lines that dynamically change during game play as determined by events occurring during the course of game play.

BACKGROUND OF THE INVENTION

Gaming machines, such as slot machines, video poker machines and the like, have been the cornerstone of the gaming industry for a number of years. Generally, the popularity of such gaming machines with players is dependent on the perceived likelihood of winning money at the machine and the intrinsic entertainment value of the machine. Players are most likely to be attracted to the most entertaining and exciting of these machines. Therefore, owner/operators of such video machines constantly strive to employ the most entertaining and exciting machines available because such machines attract frequent play and hence increase profitability to the machine operator. Accordingly, in the competitive gaming machine industry, there is a continuing need for gaming machine manufacturers to produce new types of games, or enhancements to existing games, which will attract frequent play by enhancing the entertainment value and excitement associated with games, and by increasing a player's perception that they have a better chance to win when playing a game.

In the prior art there are two types of games. There is the standard 3×5 "five reel slot" machine where all cards or slot symbols are randomly dealt/displayed and there is no player skill. The other type has a level of player skill; an example of this type of game is one in which there is an initial deal/display of cards or slot symbols from which a player selects cards or symbols to be held and the non-selected cards or symbols are replaced with new cards or symbols.

One concept that has been successfully employed to enhance the entertainment value of a game is the concept of multiple pay lines that exceed the number of actual horizontal rows of a matrix of cards or slot symbols displayed on a gaming/slot machine. In such poker/slot machines the pay lines include not only actual horizontal rows of cards or slot symbols being displayed but the pay lines also include cards or slot symbols in positions in more than one horizontal row of the matrix. Thus, some pay lines zig-zag between displayed horizontal rows and the number of pay lines exceed the actual number of horizontal rows of cards or slot symbols being displayed in the matrix.

In such prior art a typical gaming device might have a 3×5 matrix (3 rows by 5 columns) called a "five reel slot". This matrix easily and clearly supports three horizontal pay lines through the three rows of the matrix. To increase the number of pay lines the gaming industry has created pay lines that zig-zag between the rows of the 3×5 matrix while still picking only one symbol per column in the matrix. With this technique there are $3^5$ ways of choosing five symbols, one from each column in a 3×5 matrix.

However, in this prior art all pay lines are fixed and are selected in a fixed order and never change during the course of play. The only flexibility a player has is how many pay lines they select to be played and the pay line multiplier. Such prior art is described in U.S. Pat. No. 6,652,377 issued Nov. 25, 2003 to E. Moodie.

For one example, a player places a number of wagers and for each wager another pay line is selected to be played. In addition, a wager multiplier may be selected for the pay lines. Following the player's selection of the wagers and multiplier, an initial deal of cards or display of slot symbols is made in a first horizontal row of the matrix from which the player selects one, some, or all of the cards or slot symbols in the row to be held. The held slot symbols or cards are reproduced in the same column of all other horizontal rows in the matrix. The non-selected cards or symbols of the initial deal are discarded. A second and final deal is made to replace the non-selected slot symbols or cards in the first horizontal row and to fill the empty card or slot symbol positions in the other horizontal rows in the matrix. The player only has control over the number of pay lines selected to be played and the pay line multiplier, and not over the order in which they are selected. All pay lines are fixed and never change during the course of play. Such a prior art game is described in U.S. Pat. No. 5,823,873 issued Oct. 20, 1998 to E. Moodie.

Thus, there is a need in the gaming art for a new gaming option that provides dynamic selection of pay lines during game play as determined by events occurring during the course of game play. These dynamic events may be: (a) player initiated events associated with game play that dynamically determine either or both the number of pay lines and the path of pay lines through a matrix of slot symbols or cards during the course of play of the game, and (b) game actions automatically initiated during the course of game play that dynamically determine the path of pay lines through a matrix of slot symbols or cards. Such dynamic selection of pay lines during game play have the potential to make a game more interesting.

SUMMARY OF THE INVENTION

The previously described need in the art for a new gaming option that provides dynamic selection of pay lines during game play as determined by events occurring during the course of game play is satisfied by the present invention. Pay lines are dynamically selected (or altered) during the course of game play responsive to decisions made by a player during the course of game play. Before commencement of game play all pay lines have an initial position, alike the prior art, but during game play the pay lines change based on dynamic game events.

In a first type of dynamic pay line game play, after a player selects a number of play lines and a number of bets per pay line in a manner known in the art, a first set of slot symbols or cards (an operating hand) is initially dealt into the display positions of one particular row of the matrix and a player selects none, one, some, or all the slot symbols or cards to be held and played. At the start of each game a standard set of initial or default pay line paths are defined through the game matrix before any cards or slot symbols are dealt and selected to be held in the event that a player does not choose any slot symbols or cards to be held and others to be replaced. In such an event the initial or default pay lines are used to define winnings.

After cards or symbols are selected to be held the non-selected slot symbols or cards are discarded and replaced. Non-selected slot symbols or cards determine into which positions in the multiple columns of the matrix subsequent slot symbols or cards will be replaced and displayed. A subsequent deal of slot symbols or draw of cards completes the display of slot symbols or hands of cards in the matrix. The path of pay lines from left to right through the multiple columns of slot symbols or hands of cards are dynamically determined by steering the pay lines through the slot symbols or cards held/selected by the player after the initial deal. The path through the matrix of cards or symbols of each pay line determines the winnings for that pay line. Thus, pay lines are not fixed before game play, as in the prior art, but in the first embodiment of the invention are determined by an event occurring during the course of game play, that being the slot symbols or cards selected by a player to be held.

In a second type of dynamic pay line game play, after a player selects a number of play lines and a number of bets per pay line in a manner known in the art, and initiates game play, cards are dealt into all positions in the matrix. To dynamically determine the pay lines through the multiple display positions in the matrix a second deal or spin is performed at the same time that the first deal of cards or symbols is performed, but the second deal or spin is not done to replace any of the slot symbols or cards displayed in the matrix. Rather, the second deal randomly selects and displays on all display positions of the matrix a color, symbol, number or other graphical indicia. Each pay line zig-zags through display positions in the matrix having the same color, same symbol or same graphical indicia. The slot symbols or cards along each pay line determine the player winnings for that pay line.

In a variation of the second type of dynamic pay line game play there is a third deal that is accomplished at the same time as the first and second deals described in the previous paragraphs. The third deal randomly selects and displays on all display positions of the matrix a color, symbol or other graphical indicia. The third deal is done in the same manner as described in the previous paragraph. Additional pay lines are provided that zig-zag through display positions in the matrix having the same second set of colors, symbols or indicia.

There is a third type of dynamic pay line game play that may be utilized separately or may be utilized with each of the first two types of dynamic pay line game play. Prior to game play a player operates an on-screen Select Hands button to select additional hands to play in a manner known in the art. A hand being a collection of cards (or symbols) that implicitly defines the pay line for those cards. However, at the commencement of each game after the player touches the on-screen Deal button to start game play, they are notified of a randomly selected number between 1 and 3 that indicates a number of additional pay lines they receive during game play. The number of additional pay lines changes for every deal of the cards. While receiving additional pay lines appears to the advantageous to a player the changed odds are compensated for in the pay table.

In accordance with the teaching of the invention the total number of pay lines a player is playing for each round of game play of slots or cards is dynamically determined during the course of game play. A player selects a number of pay lines to play but bonus pay lines are awarded to the player dependent upon decisions made by the player during the course of game play. Each position of a display matrix has an indicia displayed thereon and under predetermined ones of the indicia is an indicator that the player has been awarded bonus pay lines. Before initiating a round of slots game play the player touches one of the displayed indicia which then disappears to reveal if there is an indication there under that the player has been awarded bonus pay lines. More particularly, before or after dealing an initial hand of cards during each round of game play of cards the player touches one of the displayed indicia which then disappears to reveal if there is an indication there under that the player has been awarded bonus pay lines.

At the end of each round of game play of slots or cards the number of pay lines the player has is equal to the number of pay lines initially chosen by the player plus any awarded bonus pay lines. After each round of game play the number of bonus pay lines indicated under the non-selected predetermined ones of the indicia increases until all such indicia have been selected by a player during sequential rounds of game play. The bonus pay lines may be required to pass through the position in the display matrix touched by the player in which the additional pay lines were awarded.

DESCRIPTION OF THE DRAWINGS

The present invention will be better understood upon reading the following Detailed Description in conjunction with the drawings in which.

DETAILED DESCRIPTION

The dynamic pay lines of the present invention may be used with any game of chance comprising a card game or slot symbols as described in the summary of the invention and in the following detailed description. However, only for the sake of simplicity, in the following detailed description and the drawings (FIGS. 3-12) associated therewith, only playing cards are shown for playing poker. However, it should be clearly understood that the present invention may also be used with standard slot machine symbols such as, but not limited to, cherries, plums, bells, etc. such as shown in FIGS. 13-18. Further, in the following detailed description of FIGS. 3-12 a separate deck of cards are used to deal the cards in each row of a game matrix so the same card may appear in more than one row. However, one deck of cards may alternatively be used to deal all cards in all positions in the game matrix.

Figure 1:
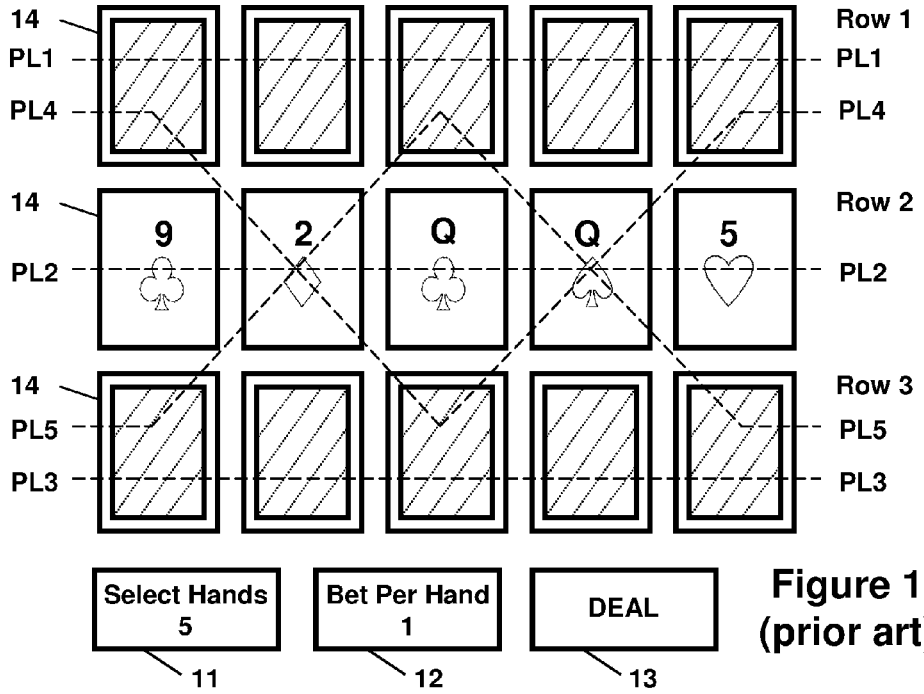
Figure 1 (prior art)
FIG. 1 shows a typical set of fixed pay lines of a prior art video poker game superimposed on a first hands of cards that are dealt prior to cards being held and final cards being drawn during play of the poker game.
Figure 2:
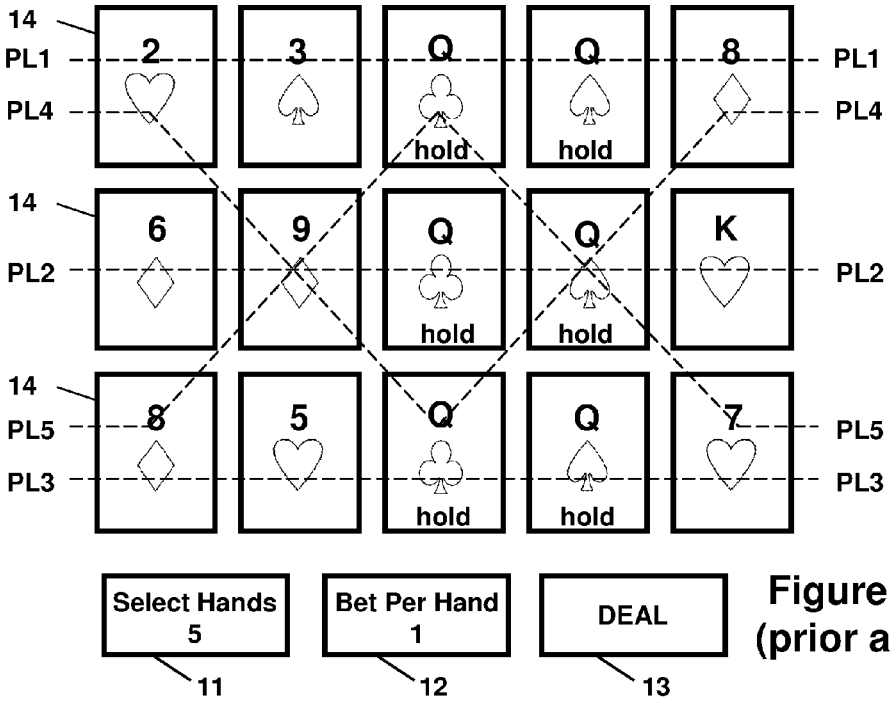
Figure 2 (prior art)
FIG. 2 shows the fixed pay lines of the prior art video poker game in FIG. 1 superimposed on three hands of cards that are displayed on the screen following a final draw of cards during play of the poker game.

In each of FIGS. 1 through 12, and other figures, is shown a rectangular display of a game matrix having fifteen rectangular blocks arranged in a three by five grid of display positions in which cards are dealt and played for multiple hands at a time. This matrix layout of card positions and mode of play are well known in the prior art as shown in FIGS. 1 and 2. While only three rows of card positions and cards are shown in these figures, more than three rows may be displayed and played as is also known in the art. Similarly, while five columns are shown, more or less columns may be displayed. For the purpose of this description only the three rows designated Row 1, Row 2 and Row 3 and five columns (undesignated) in the figures are shown and described. For the purposes of this description only, and for simplicity, a limited maximum number of six pay lines designated PL1, PL2, PL3, PL4, PL5 and PL6 are shown and described. However, many more pay lines may be utilized as is known in the art. The pay lines themselves are represented as dashed lines through the hands of cards shown in the figures. At the end of a game the machine typically shows each pay line individually so that the player can identify those cards that are associated with the pay line and any win that might have occurred on that hand.

At the end of each game, credits are awarded to a player for each winning card combination along a pay line based on a predetermined schedule called a "pay table". The number of bets wagered on each pay line multiplies the amount of winnings indicated by the pay table. For example, a player may wager three bets on each of five played pay lines and collect triple the amount indicated on the pay table for each of the five played pay lines.

Figure 3:
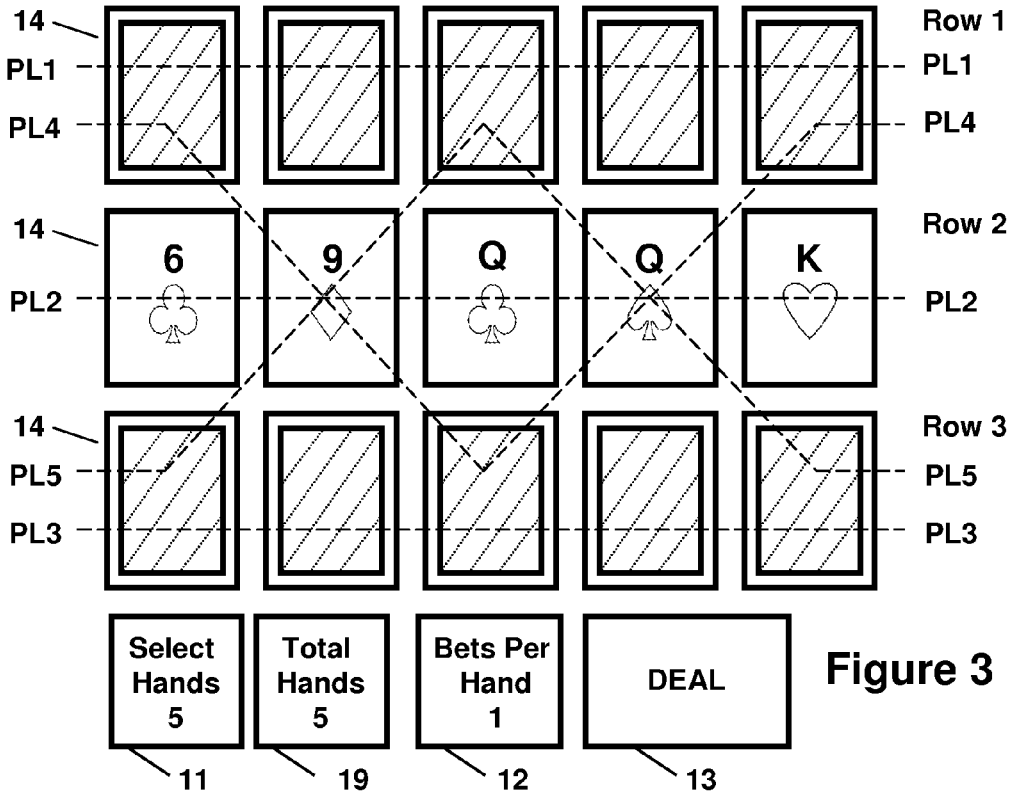
FIG. 3 shows a first hand of cards dealt at the start of a first type of dynamic pay line game play where an event occurring during the course of game play, player choices of cards to be held, will determine the dynamic pay lines for the game.
Figure 4:
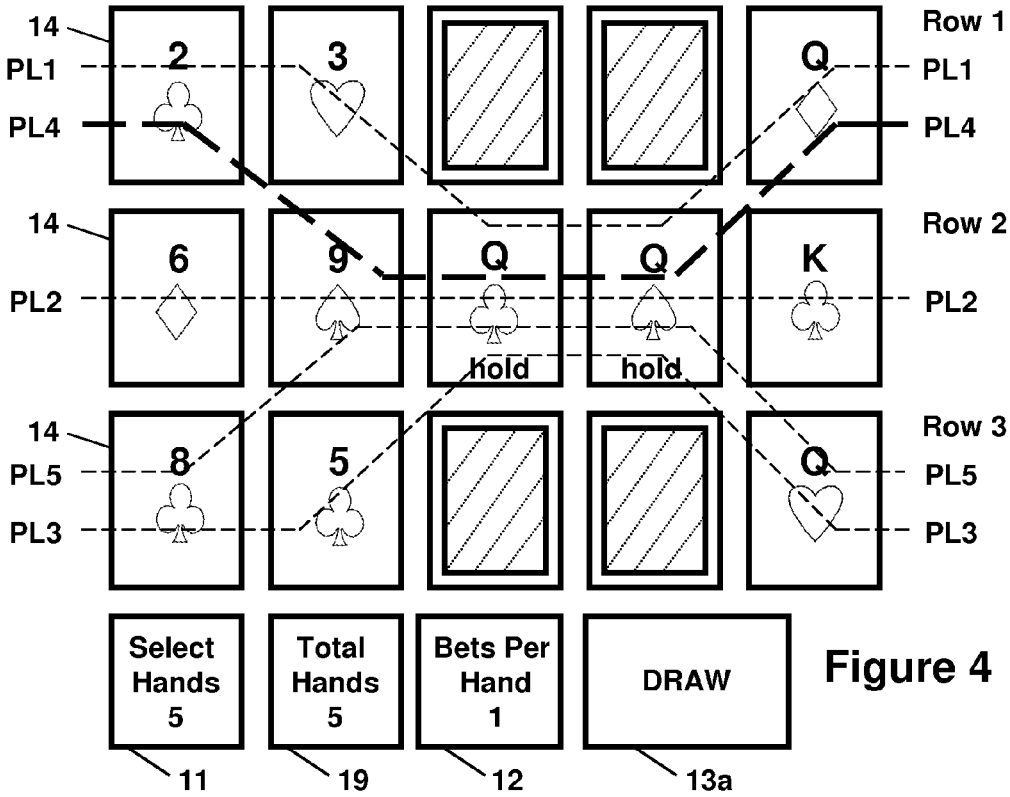
FIG. 4 shows the dynamic pay lines determined by choices made by the player during the first type of dynamic pay line game play shown in FIG. 3 and the winning hands corresponding to those pay lines.
Figure 5:
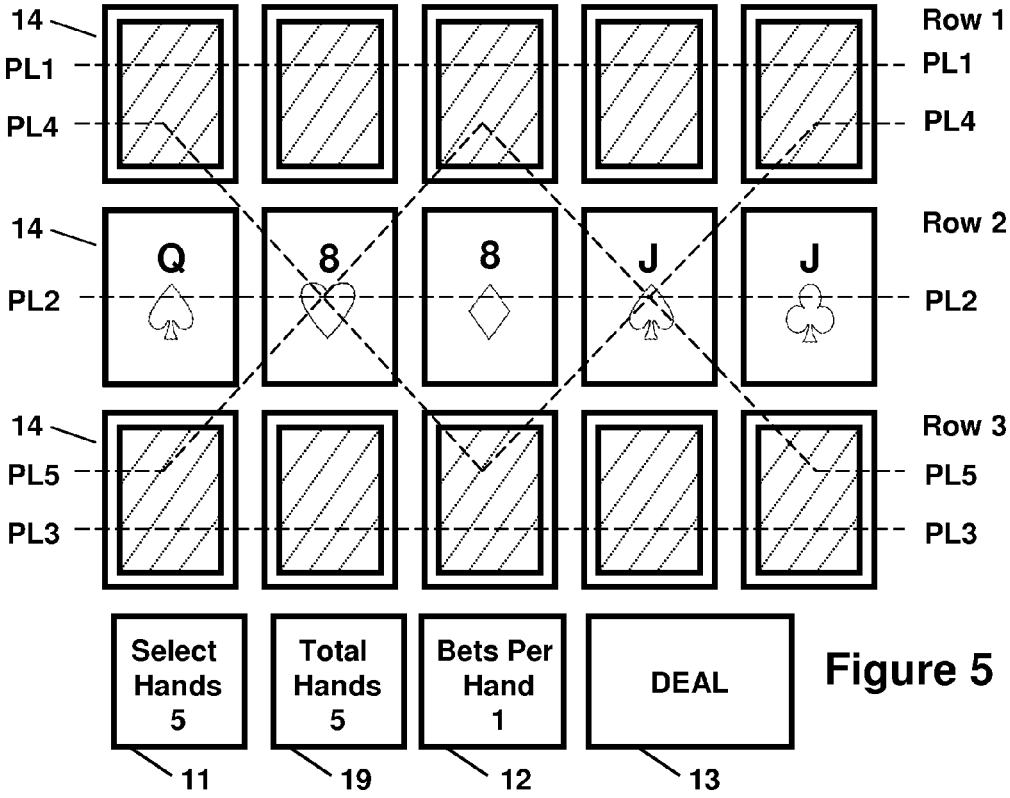
FIG. 5 shows a first hand of cards dealt at the start of game play for a second example of the first type of dynamic pay line game play and the player choices of cards to be held that will determine the dynamic pay lines for the game.
Figure 6:
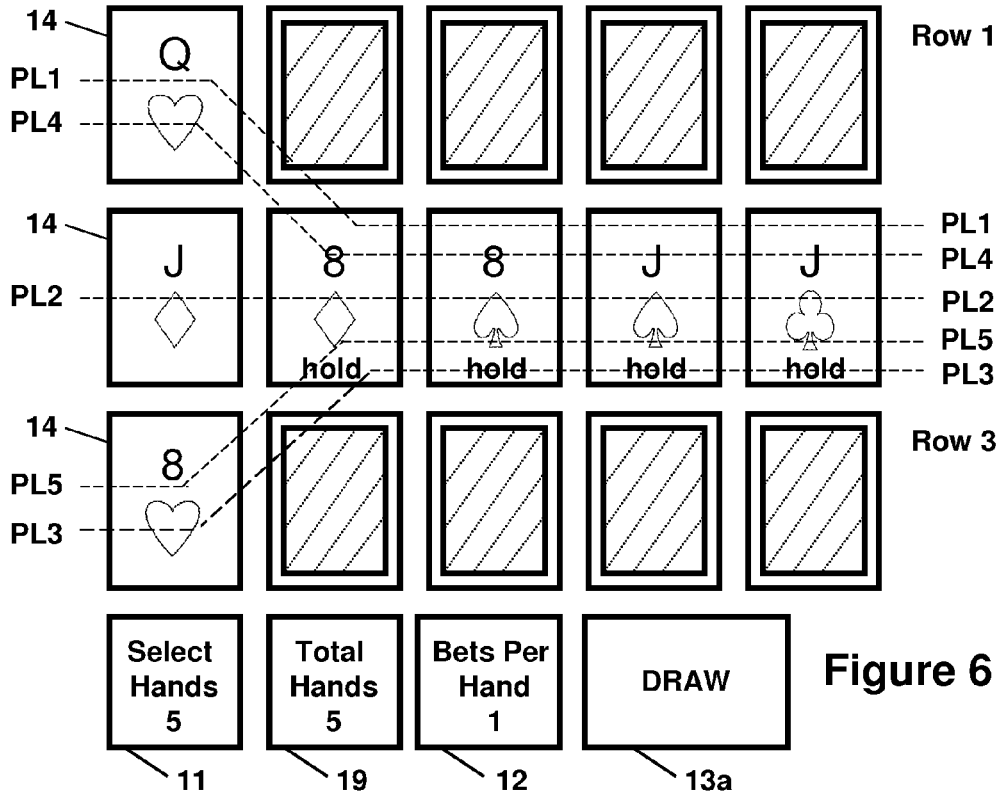
FIG. 6 shows the dynamic pay lines determined by choices made by the player during game play of the second example of the first type of dynamic pay line game play and the winning hands corresponding to those pay lines.
Figure 7:
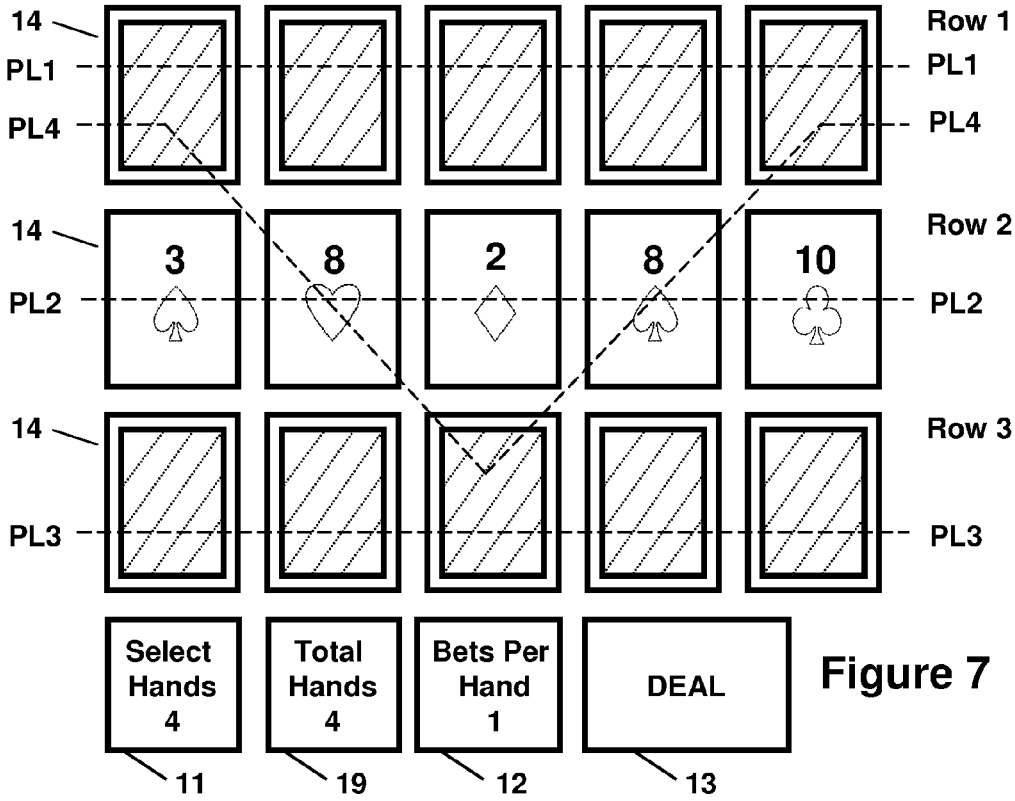
FIG. 7 shows a first hand of cards dealt at the start of game play for a third example of the first type of dynamic pay line game play and the player choices of cards to be held that will determine the dynamic pay lines for the game.
Figure 8:
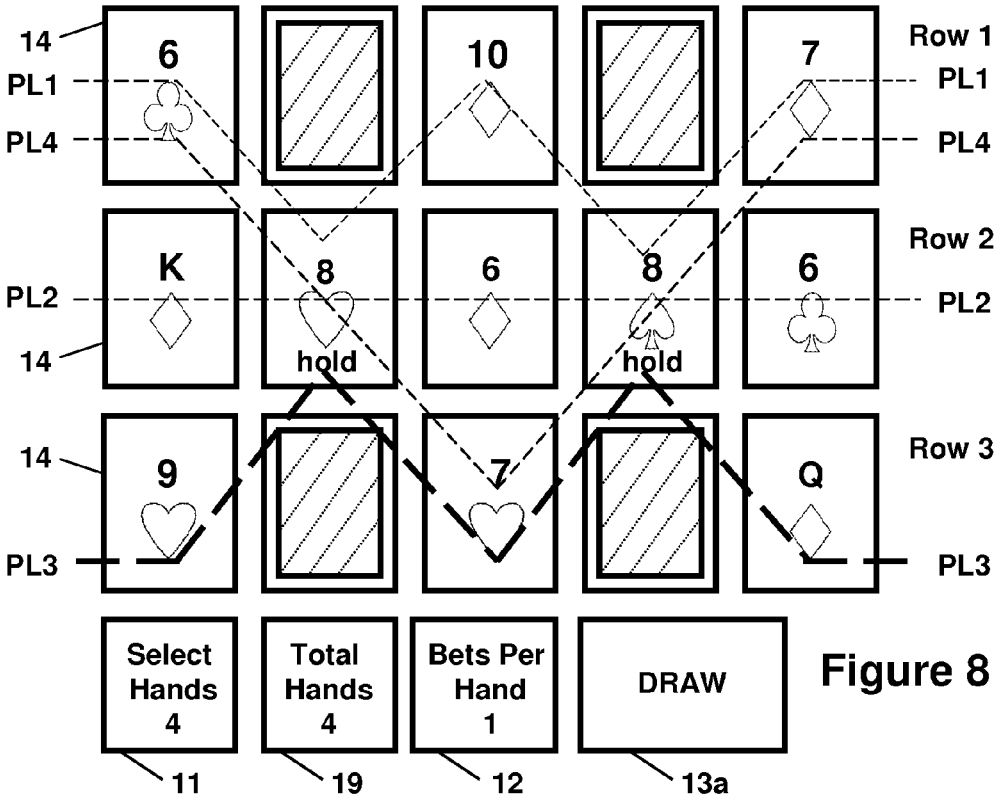
FIG. 8 shows the dynamic pay lines determined by choices made by the player during game play of the third example of the first type of dynamic pay line game play and the winning hands corresponding to those pay lines.
Figure 9:
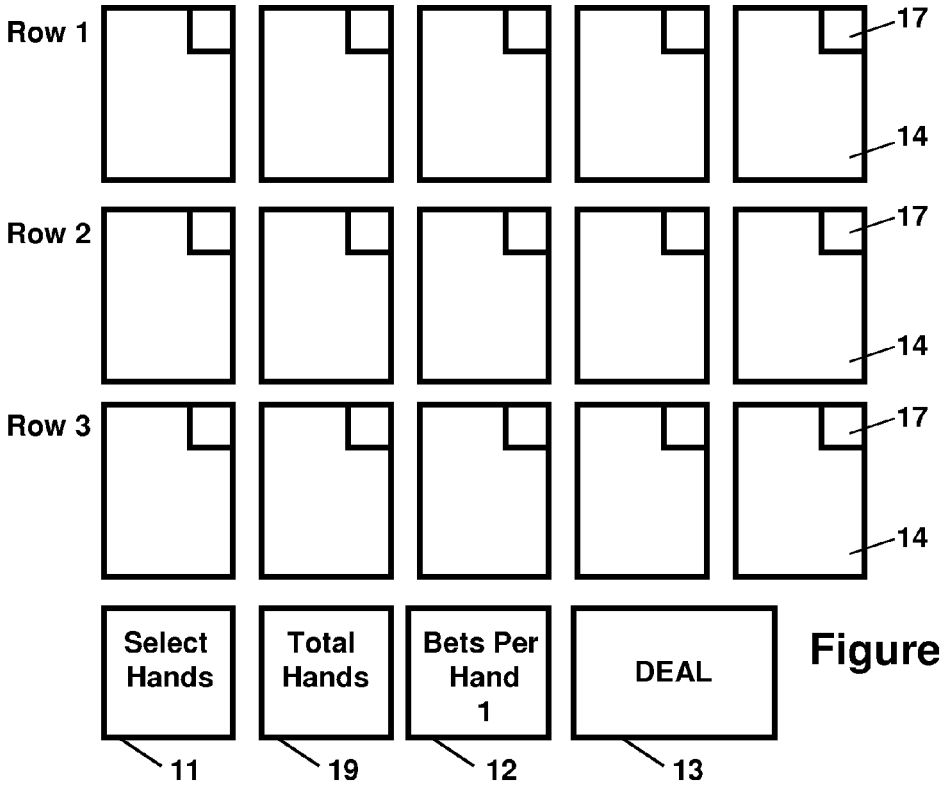
FIG. 9 shows the 3×5 game matrix used for a second type of dynamic pay line game play where dynamic pay lines are determined by events occurring during the course of game play and the events are indicated as a display of colors, symbols or other indicia that are associated and displayed with each position in a matrix of slot symbols or cards.
Figure 10:
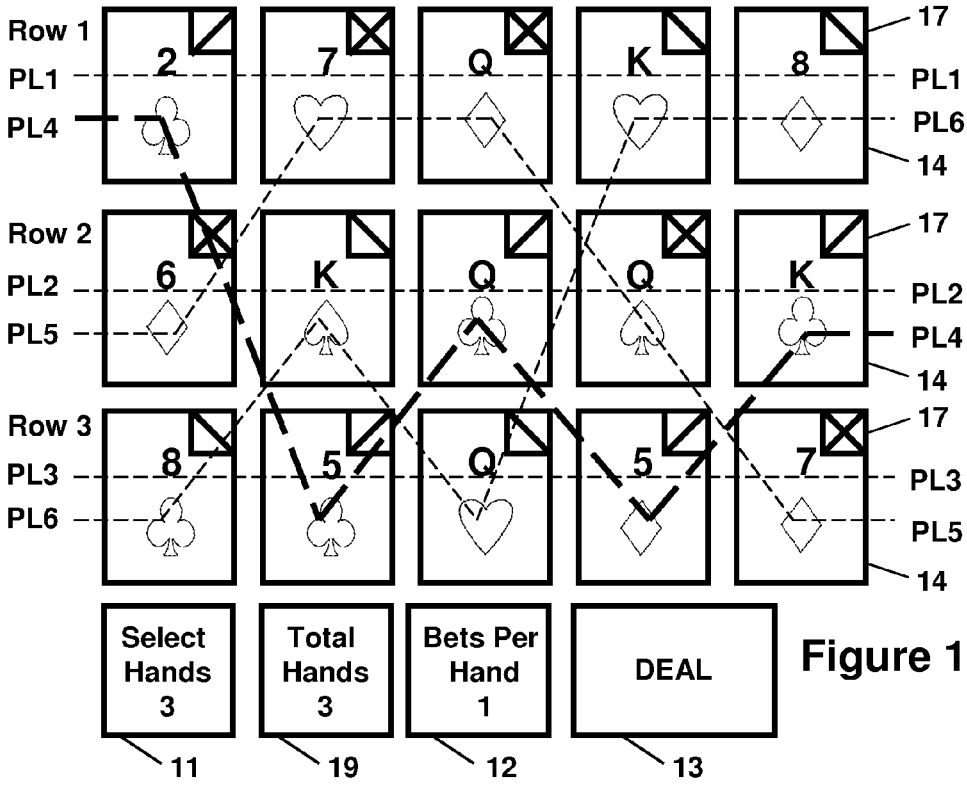
FIG. 10 shows the game play for a first example of the second type of dynamic pay line game play where all cards or slot symbols are dealt/displayed and dynamic pay lines are then determined and displayed by a separate random selection of the colors, symbols or other indicia that are associated with and displayed with each position in the matrix of slot symbols or cards.
Figure 11:
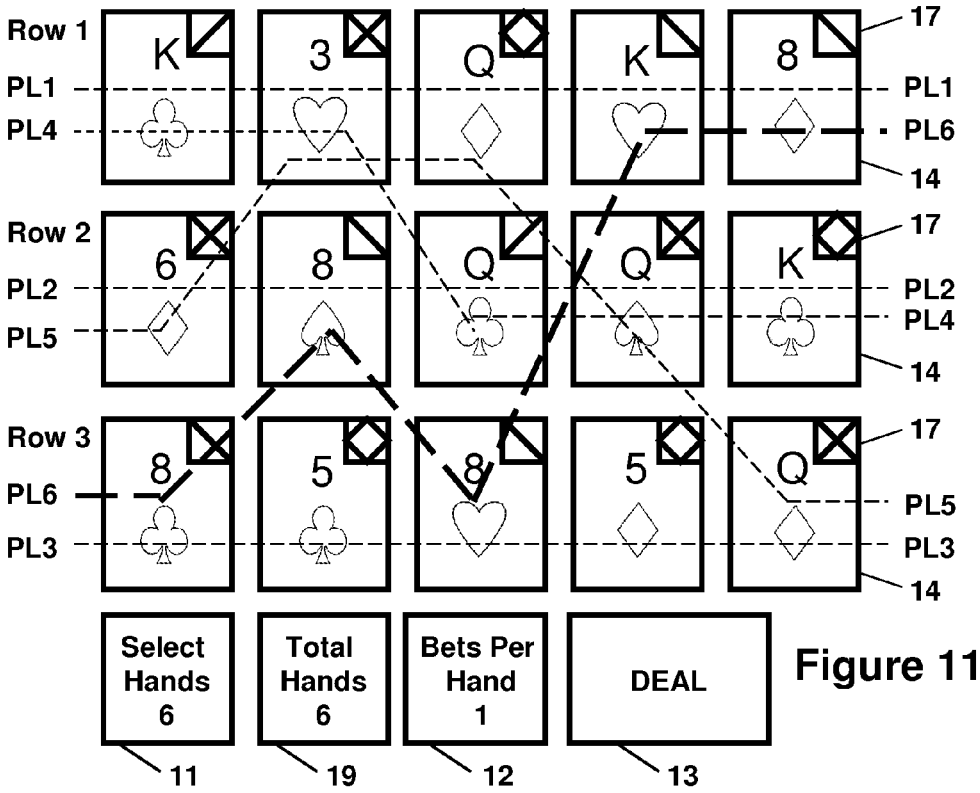
FIG. 11 shows the game play for a second example of the second type of dynamic pay line game play where cards or slot symbols are dealt/displayed and dynamic pay lines are concurrently determined and displayed by a separate random selection of the colors, symbols or other indicia that are associated with and displayed with each position in the matrix of slot symbols or cards.
Figure 12:
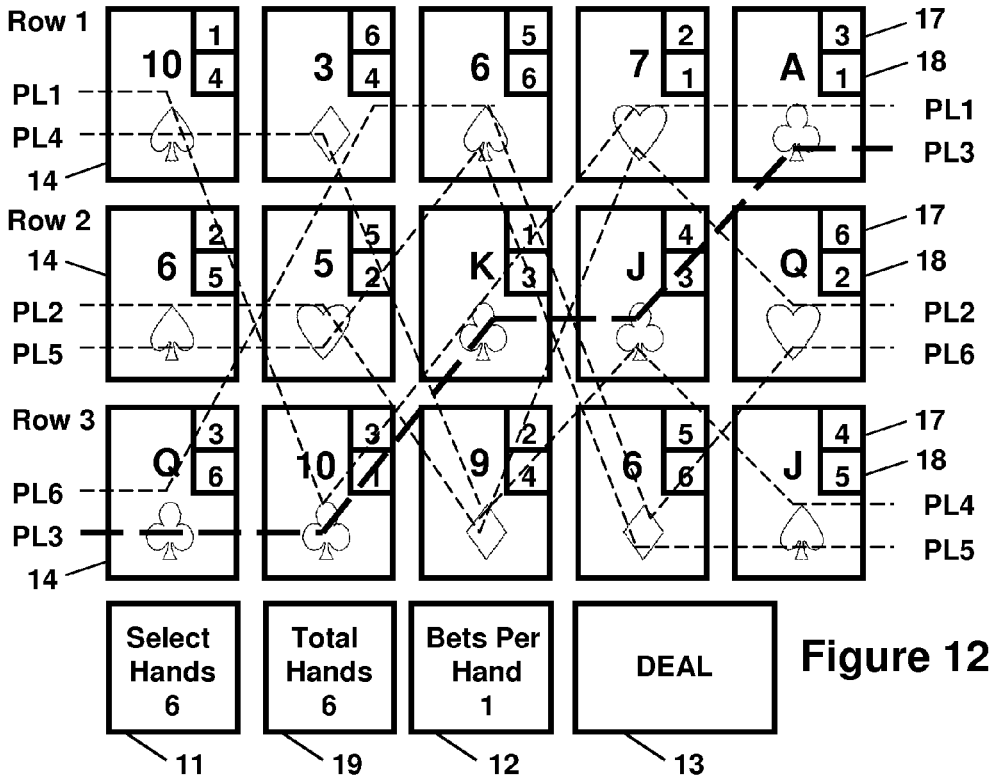
FIG. 12 shows the game play for a third example of the second type of dynamic pay line game play where cards or slot symbols are dealt/displayed and dynamic pay lines are concurrently determined and displayed by two, separate random selections of the colors, symbols or other indicia that are associated with and displayed with each position in a matrix of slot symbols or cards.

First, shown in FIGS. 1 and 2 is a prior art version of non-dynamic, fixed, zig-zag pay lines. FIGS. 3 and 4 show a first example of a first type of dynamic pay line game play. FIGS. 5 and 6 show a second example of the first type of dynamic pay line game play. FIGS. 7 and 8 show a third example of the first type of dynamic pay line game play. FIG. 9 shows a variant matrix used with a second type of dynamic pay line game play. FIG. 10 shows a first example of a second type of dynamic pay line game play. FIG. 11 shows a second example of the second type of dynamic pay line game play. FIG. 12 shows a third example of the second type of dynamic pay line game play.

A third type of dynamic pay line game play is shown in FIGS. 13-18 and is described in detail further in this Detailed Description. FIGS. 19-23 depict a fourth type of dynamic pay line game play in which pay lines are dynamically determined during the course of game play of slots or cards dependent on choices made by a player during game play.

In FIG. 1 is shown a 3×5 matrix of three rows of five card positions in each position of which cards are displayed to a player during the course of play of a prior art game poker game. Also shown are five fixed pay lines PL1-PL5 through the matrix that are fixed prior to and for all games played. The only player choice that affects the pay lines utilized in a game is the player's selection of how many hands of cards will be played during a game. When a player selects to play three hands of cards they will always get the same three pay lines, and when they select to play five hands of cards they will always get the same five pay lines. The paths of pay lines through the prior art 3×5 matrix are always fixed.

FIG. 1 shows the prior art fixed pay lines and a first hand of dealt cards in Row 2 from which the player selects cards to be held and all other cards in Row 2 are to be redrawn. FIG. 2 shows the prior art fixed pay lines and a final draw of cards after the player selects cards in Row 2 to be held. In FIG. 1, in Row 2, the Queen of Clubs in column 3 and the Queen of Spades in column 4 are the two cards held for the game example depicted in FIGS. 1 and 2. It should be noted that in the prior art choices made by the player, or any other game events during the course of game play, do not affect the path of the fixed pay lines PL1-PL5. They are fixed.

Using fixed pay lines, such as the five exemplary pay lines PL1 through PL5 in FIGS. 1 and 2, more hands of cards may be played than represented by the three rows (Row 1 through Row 3) of card positions 14 shown on the video display. This is done by having fixed pay lines (PL1, PL2 and PL3) that pass through all the cards displayed in each of the three individual rows (Row 1, Row 1 and Row 3), and fixed pay lines (PL4 and PL5) that pass through cards in different rows of the matrix as shown. More specifically, a pay line passes through one card in each of the five columns in the matrix of display positions. While only five fixed pay lines PL1-PL5 are shown in FIG. 1 for simplicity, there may be additional pay lines that zig-zag through the three rows, one for each additional hand of cards played. It is again emphasized that no matter what choices are made by a player during game play, or whatever game events occur, the fixed pay lines PL1-PL5 never change. A prior art game of the type described with reference to FIG. 1 is described in further detail in previously cited U.S. Pat. No. 6,652,377.

With the prior art game shown in FIG. 1 a player makes a wager to play one or more poker hands which are displayed as "Select Hands" on a video display that looks like a multi-line slot machine. This is done by first selecting the number of hands to be played by touching the on-screen Select Hands button 11*a* number of times equal to the number of hands selected by a player to be played. The maximum number of hands that can be played equals the maximum number of pay lines provided in the game. As shown in simplified form in FIG. 1, there are five pay lines which equal five hands of cards. Next, the player selects the number of bets to be wagered on each hand by touching the on-screen Bets Per Hand button 12 a number of times equal to the number of bets per hand to be wagered. Typically, a player must wager the same number of bets on each selected hand of cards. A player cannot place 2 bets on the first hand (PL1) and a different number of bets on say the third hand (PL3). Although not shown in FIG. 1 the player inserts an appropriate number of coins or tokens, or inserts a debit type card used to place bets, in a manner well known in the art. After this is done the player touches the on-screen Deal button 13. The reels representing each of the five columns of the matrix are spun a first time and one row of playing cards, representing a first hand, is displayed to the player only in middle Row 2.

The player then selects none, one or up to all of the face up cards from the first dealt hand of cards shown in Row 2 as cards to be held. As described above, for the prior art example shown in FIGS. 1 and 2, the Queen of Clubs and Queen of Spades are held and the non-selected cards in columns 1, 2 and 5 are discarded. The held Queen of Clubs and Queen of Spades in Row 2 are duplicated from Row 2 into the same columns of Rows 1 and 3 as shown. The player then touches the on-screen Deal button 13 a second time. All card positions in columns 1, 2 and of Rows 1 through 3 which are not held are re-spun and new cards are drawn and displayed in these card positions so that each row now has a five card hand displayed therein as shown in FIG. 2. The poker hand ranking of each five card hand along each of the five fixed pay lines PL1-PL5 played by the player is then determined. There is one card in each of the five columns. The player is paid for any winning poker hands on the pay lines based on a pay table and multiplied by the amount of the player's bet per hand. In the prior art example shown in FIG. 1 pay lines PL2, PL4 and PL5 each has jacks or better.

In accordance with the teaching of the present invention pay lines are not fixed, as in the prior art, as described above with reference to FIGS. 1 and 2, but are dynamically determined by game events during game play such as by choices made by a player during the course of game play, or by events occurring during the course of game play such as the separate random selection of indicia associated with and displayed with each position in the 3×5 matrix of slot symbols or cards during game play.

FIGS. 3 and 4 show a first example of a first type of dynamic pay line game play in which pay lines are dynamically altered during the course of game play responsive either to an event occurring during the course of game play which is a player selecting held cards during the course of game play. The pay lines will vary from game play to game. Initially the pay lines are always the same at the start of play before any cards are held and are shown in FIG. 3. In the first type of dynamic pay line game play the number of pay lines used in a round of game play equals the number of hands selected by a player to be played, but the path of the pay lines change dynamically during the course of game play. For this first example, it is assumed that the player has selected to play all five pay lines PL1-PL5 as shown in Select Hands block 11. As previously described, only for the sake of simplicity, a maximum of five play lines are shown and described, but more pay lines may be provided, selected and played.

Similar to the prior art described with reference to FIGS. 1 and 2, for the first type of dynamic pay line game play shown in FIGS. 3 and 4, a game is started with the back side of cards being displayed in each position of the 3×5 matrix. The player selects the number of hands to be played using Select Hands button 11 and the number displayed on button 11 is incremented each time button 11 is touched. The player then selects a number of bets per hand using Bets Per Hand button 12 and the number displayed on button 12 is incremented each time button 12 is touched. As shown on button 11 in FIG. 3 five hands have been selected to be played and these are represented by pay lines PL1-PL5, and there is only one bet per hand selected as shown on button 12. The Deal button 13 is then touched and a first hand of five cards is dealt in middle Row 2 as shown in FIG. 3. Immediately after Deal button 13 has been touched to deal the hand of cards in Row 2 of FIG. 3, the title of this button changes to Draw button 13*a*. The player studies the dealt hand and the initial set of pay lines also displayed and picks cards to hold, if any. In this first example of the first type of dynamic pay line game play the player elects to hold the queen of clubs and the queen of spades in the third and fourth columns of Row 2. The word "hold" does not appear on the screen on these two cards in FIG. 3, but may be added to aid a player in remembering what cards they have selected to be held. In an actual video gaming machine the player would select these two cards by touching the face of the cards displayed on the video screen which is equipped with touch screen technology, or with buttons corresponding to each column. In the event that a player elects not to hold any cards, then the standard initial pay lines PL1-PL5 shown in FIGS. 3, 5, 7 and other Figures are used for the game and there are no dynamic pay line changes during the course of game play.

Turning now to FIG. 4. After a player selects cards to be held, as indicated by the word "hold" on the queen of clubs and the queen of spades, they touch Draw button 13*a* (which was previously Deal button 13) displayed on the video screen. The card positions in middle Row 2 (columns 1, 2 and 5) that do not have player selected held cards displayed therein are discarded and new cards are drawn and displayed in these non-held card positions so that Row 2 has the final five card hand shown in FIG. 4. At the same time cards are dealt into all other matrix positions of columns 1, 2 and 5 as shown. Note that no cards are dealt into the matrix positions of columns 3 and 4 above and below the held cards in Row 2. Instead, the back side of the cards continues to be displayed in these positions as shown because these cards are not in play.

The starting point of each pay line is always the same and is shown by the indications PL1 through PL5 at the left side of FIGS. 3 and 4. If a player elects to play three hands at the start of a game they will get the dynamic pay lines that always start at PL1, PL2 and PL3 at the left side of FIG. 4. If the player elects to play five hands at the start of a game they will get the dynamic pay lines that always start at PL1 through PL5 at the left side of FIG. 4. In accordance with the teaching of the present invention, the paths of the pay lines are dynamically determined responsive to events occurring during the course of game play which, for this first example of the first type of dynamic pay line game play, is a player selecting cards to be held after the deal of the first hand in Row 2. In this first example the queen of clubs and the queen of spades are held. As previously described the default pay lines PL1-PL5 become the final pay lines in the event that the player selects no cards to be held.

The rules that govern how dynamic pay lines are drawn for the first type of dynamic pay line game play are as follows, but it should be understood that these rules may vary responsive to events occurring during the course of game play. The following example of game play is for five pay lines, but the rules also apply to a greater number of pay lines. Each of the pay lines PL1 through PL5 has an initial fixed path through the rows and columns of the display matrix as shown in FIG. 3 as previously described. Originating at its starting point each of pay lines PL1 through PL5 initially start to follow their default paths as shown in FIG. 3. The pay lines traverse from column to column following their default paths until a pay line is dynamically changed by a held card appearing in the next column in Row 2. In that event the pay line changes path dynamically to pass through the held card. When there is no held card in the next column of the matrix the pay line will return to its default path.

In FIG. 3 pay line PL1 has a default path left to right across Row 1 as shown. Cards are held and the Draw button 13*a* is touched and the new dynamic pay lines are determined as shown in FIG. 4. Following the dynamic pay line rules described in the previous paragraph pay line PL1 initially starts at column one of Row 1 and passes through the two of clubs and three of hearts as shown in FIG. 4. In the third column is the held queen of clubs so pay line PL1 is dynamically altered to pass through this card in accordance with the pay line rules. As pay line PL1 progresses to column four there is the held queen of spades so pay line PL1 remains in Row 2 through the fourth column. There is no held card in the fifth column so pay line PL1 returns to its default path and passes through the queen of diamonds in column five of Row 1 to define a five card hand having three queens.

Similarly, pay line PL3 has a default path left to right across Row 3 as shown in FIG. 3. Following the dynamic pay line rules described in the previous paragraph pay line PL3 starts at column one of Row 3 and passes through the eight of clubs and five of clubs. In the third column and Row 2 is the held queen of clubs so pay line column PL3 changes course and passes through this card as shown. As pay line PL3 progresses to column four there is the held queen of spades so pay line PL3 remains in Row 2 through the fourth column. There is no held card in the fifth column so pay line PL3 returns to its default path and passes through the queen of hearts in column five of Row 3 to define a five card hand having three queens.

Pay line PL2 starts at the left of Row 2 and will always traverse only across Row 2 since there is no need to change to another row to pass through a held card. If a different set of pay line rules are used this situation could be different.

Pay line PL4 starts at the left side of Row 1 and its default path is through the two of clubs and the nine of spades. Since there is a held queen of clubs in column three of Row 2 pay line PL4 cannot continue following its default path to Row 3 but instead passes through the queen of clubs in column three of Row 2. As pay line PL4 progresses to column four there is the held queen of spades so pay line PL4 remains in Row 2 through the fourth column. In this instance the queen of spades lies in the default pay line. There is no held card in the fifth column so pay line PL4 returns to its default path and passes through the queen of diamonds in column five of Row 1 to define a five card hand having three queens.

Similarly, pay line PL5 starts at the left side of Row 3 and its default path is through the eight of clubs and the nine of spades. Since there is a held queen of clubs in column three of Row 2 pay line PL5 cannot continue following its default path to Row 1 but instead passes through the queen of clubs in column three of Row 2. As pay line PL5 progresses to column four there is the held queen of spades so pay line PL5 remains in Row 2 through the fourth column. In this instance the queen of spades lies in the default pay line. There is no held card in the fifth column so pay line PL5 returns to its default path and passes through the queen of hearts in column five of Row 3 to define a five card hand having three queens.

The poker hand ranking of each five card hand along each of the five final pay lines PL1 through PL5 in FIG. 4 is then determined and is normally displayed on screen (not shown) to the player. The player is paid for any winning poker hands along these pay lines based on a pay table and the winnings are multiplied by the amount of the player's Bet per Hand. In the first example of the first type of dynamic pay line game play the dynamic pay lines described with reference to FIG. 4, pay lines PL1, PL3, PL4 and PL5 each has three queens, and pay line PL2 has a pair of queens (jacks or better). The winning hands may be displayed to the player although this is not shown in FIG. 4.

When many pay lines zig-zag through the matrix it is often hard to tell which displayed cards a pay line passes through. To solve this problem a player may touch any one of the pay line designations PL1 through PL5 along the right or left edge of the matrix. The touch is sensed by the aforementioned touch screen technology and the selected pay line will be changed to a bright color and will blink to make it easy to view the cards making up the hand along the selected pay line. In FIG. 4 the blinking and bright color cannot be shown but pay line PL4 has been bolded to emulate this action and show how a pay line may be more readily observed.

In FIG. 5 is shown a first hand of cards dealt in Row 2 during a first step of play for a second example of the first type of dynamic pay line game play. The player has selected to play five play lines as indicated by the number "5" in Select Hands box/button 11. The player has not elected to increase the number of bets per hand as indicated by the number "1" in Bet per Hand box/button 12. The player then touches Deal Button 13 to deal the initial hand shown in Row 2 of FIG. 5. Immediately after Deal button 13 has been touched the title of this button changes to Draw button 13*a* as shown in FIG. 6. The default pay lines PL1-PL5 are as shown in FIG. 5 and are the actual pay lines for the game if the player does not select any cards to be held and other cards to be replaced. After studying the cards in this first dealt hand the player selects the eight of hearts, eight of diamonds, jack of spades and jack of clubs in columns two through five of Row 2 to be held as indicated in FIG. 6.

Turning now to FIG. 6. After selecting cards to be held the player presses the on-screen Draw button 13*a* for the second step of game play. The non-selected queen of spades in column one of Row 2 is discarded and is replaced by a redrawn jack of diamonds. At the same time a card is dealt into the first card position, column one, of Rows 1 and 3. They are, respectively, the queen of hearts and eight of hearts. Note that no cards are dealt into the card positions of Rows 1 and 3 above and below the held cards in middle Row 2 per the pay line rules. Only the backs of the cards are shown. It should be noted that in the prior art there are cards in display positions that are common to more than one pay line. With the second type of dynamic pay line game play the pay lines change due to events that occur during game play. Thus, card positions which are common to more than one pay line change during the course of game play.

Following the dynamic pay line rules described above, the pay lines for the second example of the first type of dynamic pay line game play are as shown in FIG. 6. Following its default path, shown in FIG. 5, pay line PL1 initially goes to the right passing through the queen of hearts in column one of Row 1. With the held eight of diamonds being in the second column of Row 2 pay line PL1 must dynamically change course from its default path along Row 1 to Row 2 to pass through the held eight of diamonds. With the remainder of the cards in Row 2 being held cards pay line PL1 must continue through the remainder of Row 2 as shown in FIG. 6. Pay line PL2 extends through the whole of middle Row 2 since that is its default path and all the held cards are in middle Row 2.

Initially following its default path shown in FIG. 5, pay line PL3 initially goes to the right passing through the eight of hearts in column one of Row 3. With the held eight of diamonds being in the second column of Row 2 pay line PL3 must change course from its default path along Row 3 to Row 2 to pass through the held eight of diamonds. With the remainder of the cards in Row 2 being held cards pay line PL3 must continue through the remainder of Row 2 as shown in FIG. 6.

Pay line PL4 starts at the left of Row 1 and initially goes to the right passing through the queen of hearts in column one of Row 1. With the held eight of diamonds being in the second column of Row 2 pay line PL4 continues to follow its default pay line, shown in FIG. 5, and passes through the eight of diamonds. With the remainder of the cards in Row 2 being held cards pay line PL4 deviates from its default path and continues through the remainder of Row 2 and never returns to Row 3 or Row 1 where its default path is.

Pay line PL5 starts at the left of Row 3 and initially goes to the right passing through the eight of hearts in column one of Row 3. With the held eight of diamonds being in the second column of Row 2 pay line PL4 continues to follow its default pay line, shown in FIG. 5, and passes through the eight of diamonds. With the remainder of the cards in Row 2 being held cards pay line PL5 deviates from its default path and continues through the remainder of Row 2 and never returns to Row 1 or Row 3 where its default path is.

The poker hand ranking of each five card hand along each of the five pay lines PL1 through PL5 in FIG. 6 is then determined and is normally displayed on screen (not shown) to the player. The player is paid for any winning poker hands along these pay lines based on a pay table and the winnings are multiplied by the amount of the player's bet per hand. In this second example of the first type of dynamic pay line game play pay lines PL1 and PL4 each have two pairs—eights and jacks, pay line PL2 has a full house of jacks over eights, and pay lines PL3 and PL5 each have a full house of eights over jacks. The winning hands may be displayed to the player although this is not shown in FIG. 4.

It is emphasized that the two examples of the first type of dynamic pay line game play shown in FIGS. 3 & 4 and FIGS. 5 & 6 each yield entirely different dynamic pay lines resulting from events occurring during the course of game play in the form of held card selections made by a player during game play. Although not shown in FIG. 6, identical to the first example shown in FIG. 4, the player may touch ones of the designations PL1-PL5 and the selected pay line will be changed to a bright color and will blink to make it easy to view the cards making up the hand along the selected pay line.

In FIGS. 7 and 8 are shown a third example of the first type of dynamic pay line game play. A difference is introduced into this third example in that the player only selects four hands to be played as indicated by the number 4 in Select Hands button 11. Thus, only default pay lines PL1-PL4 are displayed as shown.

In FIG. 7 is shown a first hand of cards dealt in Row 2 during a first step of play for the third example of the first type of dynamic pay line game play following selecting a number of hands, the bets per hand, and touching Deal button 13. Immediately after Deal button 13 has been touched to deal the initial hand of cards shown in Row 2 of FIG. 7, the title of this button changes to Draw button 13*a* as shown in FIG. 8 in preparation for the next step of game play. The player the dealt cards and elects to hold the eight of hearts in column two and the eight of spades in column four as indicated by the word "hold" displayed on those two cards in FIG. 8.

Turning now to FIG. 8. After selecting the cards to be held the player touches on-screen Draw button 13*a* to continue game play. The originally dealt cards in the first, third and fifth columns of Row 2 that were not held are discarded and new cards, the king of diamonds, six of diamonds and six of clubs are drawn (randomly selected) in a manner known in the art and displayed in those card positions. Row 2 has a full, final five card hand. At the same time cards are dealt into the card positions of the first, third and fifth columns of Rows 1 and 3. Only the backs of cards are shown in the other columns of Rows 1 and 3. The new cards in Row 1 are the six of clubs, ten of diamonds and seven of diamonds. In Row 3 the new cards are the nine of hearts, seven of hearts and queen of diamonds. Note that no cards are dealt into the second and fourth columns of Rows 1 and 3 above and below the held cards in middle Row 2.

Following the dynamic pay line rules previously described, the four pay lines for the third example of the first type of dynamic pay line game play are dynamically determined by the two held cards and are shown in FIG. 8. Initially following its default path, shown in FIG. 7, pay line PL1 goes to the right passing through the six of clubs in column one of Row 1. With the held eight of hearts being in the second column of Row 2 pay line PL1 must change from its default path along Row 1 to Row 2 to pass through the held eight of hearts. Since there is no held card in the third column, pay line PL1 returns to its default path along Row 1 and passes through the ten of diamonds. With the held eight of spades being in the fourth column of Row 2 pay line PL1 must again change course from its default path along Row 1 to Row 2 to pass through the held eight of spades. Finally, since there is no held card in the fifth column, pay line PL1 returns to its default path along Row 1 and passes through the seven of diamonds. Pay line PL2 extends through the whole of middle Row 2 since that is its default path and all the held cards are in Row 2.

Following its default path, shown in FIG. 7, pay line PL3 initially goes to the right passing through the nine of hearts in column one of Row 3. With the held eight of hearts being in the second column of Row 2 pay line PL3 must change from its default path along Row 3 to Row 2 to pass through the held eight of hearts. Since there is no held card in the third column of the matrix pay line PL3 returns to its default path along Row 3 and passes through the seven of hearts. With the held eight of spades being in the fourth column of Row 2 pay line PL3 must again change course from its default path along Row 3 to Row 2 to pass through the held eight of spades. Finally, since there is no held card in the fifth column of the matrix pay line PL3 returns to its default path along Row 3 and passes through the queen of diamonds.

Following its entire default path shown in FIG. 7, pay line PL4 in FIG. 8 initially goes to the right passing through the six of clubs in column one of Row 1. Then it passes through the held eight of spades in the third column of Row 2, the seven of hearts in the column three of Row 3, the held eight of spades in column four of Row 2, and finally through the seven of diamonds in column five of Row 1.

A fifth pay line PL5 is not shown in FIG. 8 because the player only selected to play four hands of cards at the start of game play.

The poker hand ranking of each five card hand along each of the four pay lines PL1 through PL4 is then determined. The player is paid for any winning poker hands along these pay lines based on a pay table and the winnings are multiplied by the amount of the player's Bet per Hand. In this third example of the first type of dynamic pay line game play described with reference to FIG. 8, pay line PL1 has one pair of eights. Pay line PL2 has two pair—sixes and eights, pay line PL3 has one pair of eights, and pay line PL4 has two pair—sevens and eights. All winning hands are normally displayed on-screen to the player but this is not shown in FIG. 8 to simplify the drawing.

When many pay lines zig-zag through the matrix it is often hard to tell which displayed cards a pay line passes through. To solve this problem a player may touch any one of the pay line designations PL1 through PL5 along the right or left edge of the matrix. The touch is sensed by the aforementioned touch screen technology and the selected pay line will be changed to a bright color and will blink to make it easy to follow. The player may then easily view the cards making up the hand along the selected pay line. In FIG. 8 the blinking and bright color cannot be shown but pay line PL3 has been bolded to emulate this action and show how a final pay line is more readily observed.

In FIGS. 10 through 12 are shown three different examples of a second type of dynamic pay line game play. The similarity between the first and second types of dynamic pay line game play is that the pay lines are dynamically selected during game play as determined by events occurring during the course of game play. The difference between these two types of dynamic pay line game play is that in the first type the pay lines are dynamically determined by player initiated events such as selecting cards to be held, and in the-second type the dynamic pay lines are randomly determined during the course of game play without considering what events are initiated by the player.

In FIG. 9 is shown a game matrix consisting of three rows of five display positions 14 in which cards or slot symbols are displayed during the course of play for the second type of dynamic pay line game play. There is also a small box 17 shown in the upper right corner of each of the fifteen display positions 14 in which a randomly selected color, symbol, number or other indicia is displayed during the course of game play to indicate the path of randomly selected dynamic pay lines through the display matrix. The first and second examples of the second type of dynamic pay line game play shown in FIGS. 10 and 11 utilize this game matrix with the small boxes 17, while the third example of the second type of dynamic pay line game play shown in FIG. 12 utilizes two small boxes 17 and 18 per matrix position to provide additional dynamically variable pay lines.

In the first and second examples of the second type of dynamic pay line game play shown in FIGS. 10 and 11 a maximum of six pay lines PL1-PL6 are utilized and anywhere from one to six pay lines may be selected for play by a player. In all three examples of the second type of dynamic pay line game play, after a player selects the number of hands to be played (indicated in box 11) and selects the number of bets per hand (indicated in box 12), as described with reference to FIG. 1, Deal button 13 is touched and cards are dealt into all fifteen positions of the 3×5 matrix. The dynamic pay lines are determined by events occurring during the course of game play. The event in the case of the three examples of the second type of dynamic pay line game play described herein is the mathematical, random selection of colors, symbols, numbers or other indicia (such as plums, cherries, bananas etc.) that are displayed in the small box 17 associated with each display position in the 3×5 matrix. Two boxes 17 and 18 are used in the third example of the second type of dynamic pay line game play shown in FIG. 12. The dynamic pay lines are never fixed and change from game to game, are selected after the start of game play, and each pay line follows a particular color, symbol, number or other indicia through the matrix of boxes 17.

In the small boxes 17 in the first example of the second type of dynamic pay line game play shown in FIG. 10 a total of three indicia are utilized to be displayed in the boxes. Those indicia are "/" and "\" slash marks, and Xs. In the small boxes 17 in the second example of the second type of dynamic pay line game play shown in FIG. 11 a total of four indicia are utilized to be displayed in the boxes. Those indicia are "/" and "\" slash marks, Xs and diamonds "◇". In the small boxes 17 and 18 in the third example of the second type of dynamic pay line game play shown in FIG. 12 the total indicia utilized to be displayed in the boxes equals the number of pay lines. There are a total of six pay lines and the indicia are the number 1 through 6. The "/" and "\" slash marks, Xs, diamonds "◇" and numbers shown in FIGS. 10 and 11 are used only because they are more practical to show in the drawing. However, any other visual representations may be used. The indicia in boxes 17 and 18 are chosen randomly in each column such that the same indicia will not be repeated in any single column.

In FIG. 10 is shown the first example of the second type of dynamic pay line game play. After a player has selected a number of hands to play and a number of bets per hand, as previously described, they touch the Deal button 13. Cards are dealt into all fifteen display positions 14 of the 3×5 matrix as shown in FIG. 10. In addition, the "/" and "\" slash marks, and Xs are randomly dealt into all indicia display boxes 17 as shown.

In FIG. 10 pay lines PL1 through PL3 are static only for the sake of simplicity of presentation. Pay line PL1 goes horizontally through the five card positions in Row 1. Pay line PL2 goes horizontally through the five card positions in Row 2. Pay line PL3 goes horizontally through the five card positions in Row 3.

Pay lines PL4 through PL6 are dynamically determined by events occurring during the course of game play. The event is the display of the three indicia in the form of forward slash marks "/", reverse slash marks "\", and "X"s shown in the indicia display boxes 17 in the upper right corner of each of the fifteen card display positions 14 in FIG. 10. During different plays of the game the indicia displayed in boxes 17 will be different and, accordingly, pay lines PL4 through PL6 will be different for each game.

Dynamic pay line PL4 starts at the first column of Row 1 with the two of clubs. This card position has the randomly selected forward slash "/" in the indicia display block 17 in its upper right corner so pay line PL4 will track through all card display positions 17 throughout the 3×5 matrix having a forward slash "/" in the indicia display block 17. Thus, pay line PL4 zig-zags through the two of clubs in column 1 of Row 1, the five of clubs in the second column of Row 3, the queen of clubs in the third column of Row 2, the five of diamonds in the fourth column of Row 3, and the king of clubs in the fifth column of Row 2 as shown in FIG. 10. The reason for bolding of play line PL4 is described herein below.

Dynamic pay line PL5 starts at the first column of Row 2 with the six of diamonds. This card position has the randomly selected "X" in the indicia display block 17 in its upper right corner so pay line PL5 will track through the card display positions 14 throughout the 3×5 matrix having an "X" in their indicia display block 17. Thus, pay line PL5 zig-zags through the six of diamonds in column 1 of Row 2, the seven of hearts in the second column of Row 1, the queen of diamonds in the third column of Row 1, the queen of spades in the fourth column of Row 2, and the seven of diamonds in the fifth column of Row 3 as shown.

Dynamic pay line PL6 starts at the first column of Row 3 with the eight of clubs. This card position has the randomly selected back slash "\" in the indicia display block 17 in its upper right corner so pay line PL6 will track through the card display positions throughout the 3×5 matrix having an "\" in their indicia display block 17. Thus, pay line PL6 zig-zags through the eight of clubs in column 1 of Row 3, the king of spades in the second column of Row 2, the queen of hearts in the third column of Row 3, the king of hearts in the fourth column of Row 1, and the eight of diamonds in the fifth column of Row 1 as shown.

The poker hand ranking of each of the card hands along each of the six pay lines PL1 through PL6 in FIG. 10 is then determined. The player is paid for any winning poker hands along these six pay lines based on a pay table and the winnings are multiplied by the amount of the player's Bet per Hand in block 12. In this first example of the second type of dynamic pay line game play, described with reference to FIG. 10, pay line PL1 has nothing, pay line PL2 has two pairs—kings and queens, pay line PL3 has nothing but a pair of fives, pay line PL4 has nothing but a pair of fives, pay line PL5 has two pairs—queens and sevens, and pay line PL6 has two pairs—kings and eights. The winning hands are commonly displayed on screen to the player although this is not shown in FIG. 10 to avoid clutter in the drawing.

As previously described, any other visual representation might be used in boxes 17 and 18. This use of indicia provides the player with a convenient visual signal as to how the game has chosen the path of the pay line. However, this use of indicia is arbitrary in that the pay line itself is literally a line that indicates the path through the columns to produce a bet hand or pay line. In a method well known in the art, a colored line traverses the columns from left to right to indicate the cards or symbols that make up that pay line. In the first, second and third examples of the second type of dynamic pay line game play the use of indicia in boxes 17 and 18 provide some game drama and motivate a reason why a particular pay line path was chosen but is not dependent on them nor limited to their use or presence. It should be noted that in this second type of dynamic pay line game play described herein the pay line indicia are not repeated in any column of the display matrix and the pay lines start at the left of the matrix and go to the right of the matrix. Alternatively, the pay lines could pass between the top and bottom the display matrix and the pay line indicia not be repeated in any row of the matrix. The claims appended to this specification only mention the former example but cover the latter example when it is considered that it is merely a rotational translation of the display of the pay line indicia.

FIG. 11 shows a second example of the second type of dynamic pay line game play. The second example is similar to the first example except there are more graphical indicia than the number of rows in the matrix. In this second example there are three rows (Row 1-Row 3) and there are four indicia—the "/" and "\" slash marks, Xs, and diamonds "◇". Alike FIG. 10 pay lines PL1 through PL3 are static only for the sake of simplicity. Pay line PL1 goes horizontally through the five card positions in Row 1. Pay line PL2 goes horizontally through the five card positions in Row 2. Pay line PL3 goes horizontally through the five card positions in Row 3.

Pay lines PL4 through PL6 are dynamically selected during game play as determined by events occurring during the course of game play. Those events are the random display of the four indicia identified in the previous paragraph in the indicia display block 17 in the upper right corner of each of the fifteen card display positions 14. The dynamic pay lines are never fixed and change from game to game. These indicia are chosen randomly in each column such that the same indicia will not be repeated in any single column. Because more indicia are used than the number of rows in the matrix, there are times when an indicia will not appear in a column in the matrix. This is seen in the second example shown in FIG. 11. When this situation occurs a pay line passing through the particular indicia will continue horizontally to the right through one or more columns until, and if, the particular indicia is located in another column.

Dynamic pay line PL4 starts at the first column of Row 1 with the king of clubs. This card display position 14 has a forward slash "/" in the indicia display block 17 in its upper right corner so pay line PL4 will track through the forward slashes "/" in all indicia display blocks 17 of all card display positions 14 throughout the 3×5 matrix. Thus, pay line PL4 zig-zags through the king of clubs in the first column of Row 1, the three of hearts in the second column of Row 1 since there is no "/" displayed in any indicia display block 17 in the second column of the matrix, the queen of clubs in the third column of Row 2, the queen of spades in the fourth column of Row 2 since there is no "/" displayed in any indicia display block 17 in the fourth column of the matrix, and the king of clubs in the fifth column of Row 2 since there is no "/" displayed in any indicia display block 17 in the fifth column of the matrix.

Dynamic pay line PL5 starts at the first column of Row 2 with the six of diamonds. This card display position 14 has a "X" in its indicia display block 17 in its upper right corner so pay line PL5 will track through the "X"s in all indicia display blocks 17 of all card display positions 14 of the 3×5 matrix. Thus, pay line PL5 passes through the six of diamonds in the first column of Row 2, the three of hearts in the second column of Row 1, the queen of diamonds in the third column of Row 1 since there is no "X" displayed in any indicia display block 17 in the third column of the matrix, the queen of spades in the fourth column of Row 2 and, finally, the queen of diamonds in the fifth column of Row 3.

Dynamic pay line PL6 starts at the first column of Row 3 with the eight of clubs. This card display position 14 has a back slash "\" in its indicia display block 17 in its upper right corner so pay line PL5 will track through the "\"s in all indicia display blocks 17 of all card display positions 14 of the 3×5 matrix. Thus, pay line PL6 passes through the eight of clubs in the first column of Row 3, the eight of spades in the second column of Row 2, the eight of hearts in the third column of Row 3, the king of hearts in the fourth column of Row 1, and the eight of diamonds in the fifth column of Row 1.

The poker hand ranking of each of the card hands along each of the six pay lines PL1 through PL6 in FIG. 11 is then determined and displayed on screen to the player, although this display is not shown in FIG. 11. The player is paid for any winning poker hands along the six pay lines PL1 through PL6 based on a pay table and the winnings are multiplied by the amount of the player's Bet per Hand in block 12.

In this second example of the second type of dynamic pay line game play, described with reference to FIG. 11, pay line PL1 has a pair of kings—jacks or better, pay line PL2 has a pair of queens—jacks or better, and pay line PL3 has two pair—eights and fives. Pay line PL4 has two pairs—kings and queens, pay line PL5 has one pair of queens—jacks or better, and pay line PL6 has four eights.

As previously described, when there are many pay lines that zig-zag through the 3×5 gaming matrix it is often hard to tell which displayed cards a pay line passes through. To overcome this problem a player may touch any one of the pay line designations PL1 through PL5 along the right or left edge of the matrix. The touch is sensed by the aforementioned touch screen technology and the selected pay line will be changed to a bright color and will blink to make it easy to see. The player may then see if the cards show a winning hand along the selected pay line. In FIG. 11 the blinking and bright color cannot be shown but pay line PL6 has been bolded to emulate this action and show how a pay line may be more readily observed.

FIG. 12 shows a third example of the second type of dynamic pay line game play wherein the dynamic pay lines dynamically change during game play as determined by events occurring during the course of game play. The path of the pay lines are determined by two, separate random selections of colors, symbols, numbers or other indicia in two indicia display blocks 17 and 18 in each card display position 14 of the 3×5 matrix. As may be seen in FIG. 12 there are two indicia display blocks 17 and 18 in the upper right corner of each card display position 14 of the matrix. In FIG. 12 pay lines PL1 through PL6 are dynamically determined by the display of numbers 1 through 6 in the two indicia display blocks 17 and 18 at the upper right corner of each of the fifteen card display positions 14. The number 1 is associated with pay line PL1, the number 2 is associated with pay line PL2, etcetera through the number 6 being associated with pay line PL6.

There is a random draw of the numbers 1 through 6 for the six indicia display blocks 17 and 18 in each of the five columns in the 3×5 matrix after game play has started with the touch of Deal button 13. While numbers are chosen randomly in each columns of the matrix they are chosen randomly such that a number (indicia) will not be repeated in any single column. While in this example the quantity of numbers (indicia) equals the total number of indicia display block 17 and 18 in each column of the matrix, similar to FIG. 11 the quantity of numbers (indicia) may exceed the total number of indicia display block 17 and 18 in each column of the matrix.

In this third example of the second type of dynamic pay line game play a player initially selects the number of hands to be played by touching the on-screen Select Hands button 11*a* number of times equal to the number of hands they want top play which equals the number of pay lines through the matrix. In this third example the player has selected to play six hands as indicated by the number six displayed in button 11. The player then touches the on-screen Bet Per Hand button 12 a number of times equal to the number of bets they wish to place on each hand. In this third example the player has selected to place one bet per hand as indicated by the number one displayed in button 12. Finally, the player touches on-screen Deal button 13 to commence game play. As shown in FIG. 12 cards are dealt into all fifteen positions of the matrix and the numbers 1 through 6 (pay line indicia) are dealt into the indicia display blocks 17 and 18 of all display positions 14 at the same time, in the manner previously described, such that an indicia number is not repeated in any column of the matrix. There is no holding and redrawing of cards as in the first two types of dynamic pay line game play.

Pay line PL1 passes through the ten of spades in column one of Row 1, the ten of clubs in column two of Row 3, the king of clubs in column three of Row 2, the seven of hearts in column four of Row 1, and the ace of clubs in columns five of Row 1. Pay line PL2 passes through the six of spades in columns 1 of Row 1, the five of hearts in column 2 of Row 1, the nine of diamonds in column three of Row 3, the seven of hearts in column four of Row 1, and the queen of hearts in the fifth column of Row 2. Pay line PL3 passes through the queen of clubs in column one of Row 3, the ten of clubs in column two of Row 3, the king of clubs in the third column of Row 2, the jack of clubs in the fourth column of Row 2, and the ace of clubs in the fifth column of Row 1. Pay line PL4 passes through the ten of spades in column one of Row 1, the three of diamonds in column two of Row 1, the nine of diamonds in column three of Row 3, the jack of clubs in column four of Row 2, and the jack of spades in column five of Row 3. Pay line PL5 passes through the six of spades in column one of Row 2, the five of hearts in column two of Row 2, the six of spades in column three of Row 1, the six of diamonds in column four of Row 3, and the jack of spades in column five of Row 3. Pay line PL6 passes through the queen of clubs in column one of Row 3, the three of diamonds in column two of Row 1, the six of spades in column three of Row 1, the six of diamonds in column four of Row 3, and queen of hearts in column five of Row 2.

Cards along each of the six pay lines are then analyzed to determine any winnings. Pay line PL1 has no winnings—only a pair of tens. Pay line PL2 has no winnings. Pay line PL3 has a royal flush in clubs. Pay line PL4 has jacks or better—pair of jacks. Pay line PL5 has three sixes. Finally, pay line PL6 has two pairs—sixes and queens.

The poker hand ranking of each of the card hands along each of the six pay lines PL1 through PL6 is often displayed onscreen to the player, although this is not shown in FIG. 12 to avoid cluttering the drawing. The player is paid for any winning poker hands along the six pay lines PL1-PL6 based on a pay table and the winnings are multiplied by the amount of the player's Bet per Hand in block 12.

As previously described, when there are many pay lines that zig-zag through the matrix it is often hard to tell which displayed cards a pay line passes through. A player may touch any one of the designations PL1 through PL6 along the right or left edge of the 3×5 matrix. The touch is sensed by the aforementioned touch screen technology and the selected pay line will be changed to a bright color and will blink to make it easy to see amongst the other pay lines. The player will see for themselves if the cards along the selected pay line show a winning hand. In FIG. 12 the blinking and bright color cannot be shown but pay line PL3 has been bolded to emulate this action and show how a pay line may be more readily observed.

There is a third type of dynamic pay line game play that may be utilized with the first and second embodiments of the invention and it is utilized at the start of game play when a player touches the on-screen Deal button 13 to commence game play. The third embodiment actually encourages the player to play more hands of cards. When the on-screen Deal button 13 is touched, a number between 1 and 3 is randomly selected. The random number indicates a number of hands of cards the player will actually receive to play. The player is then notified of this number on screen in a block 23 as is described hereinafter.

As is seen in FIGS. 3-12, on screen, below the 3×5 matrix of display positions 14 there are button/display blocks 11, 12, 13 and 18 that have been previously described with reference to standard game. A player uses Select Hands button 11 to indicate the number of hands they wish to play, uses Bets per Hand button 12 to indicate a multiplier of the per hand bets, and the Deal button 13 which starts game play and is used during game play after cards are selected to be held and new cards are to be drawn.

In the prior art each time a player touches the Select Hands button 11 before starting game play they get another hand to play that corresponds to a pay line. Each time they touch on screen button Select Hands button 11 the number in the button is incremented by one up to some maximum number of games that can be played at one time. In addition, each time a player touches Select Hands button 11 they are debited or charged the amount to play one hand/pay line.

Figure 16:
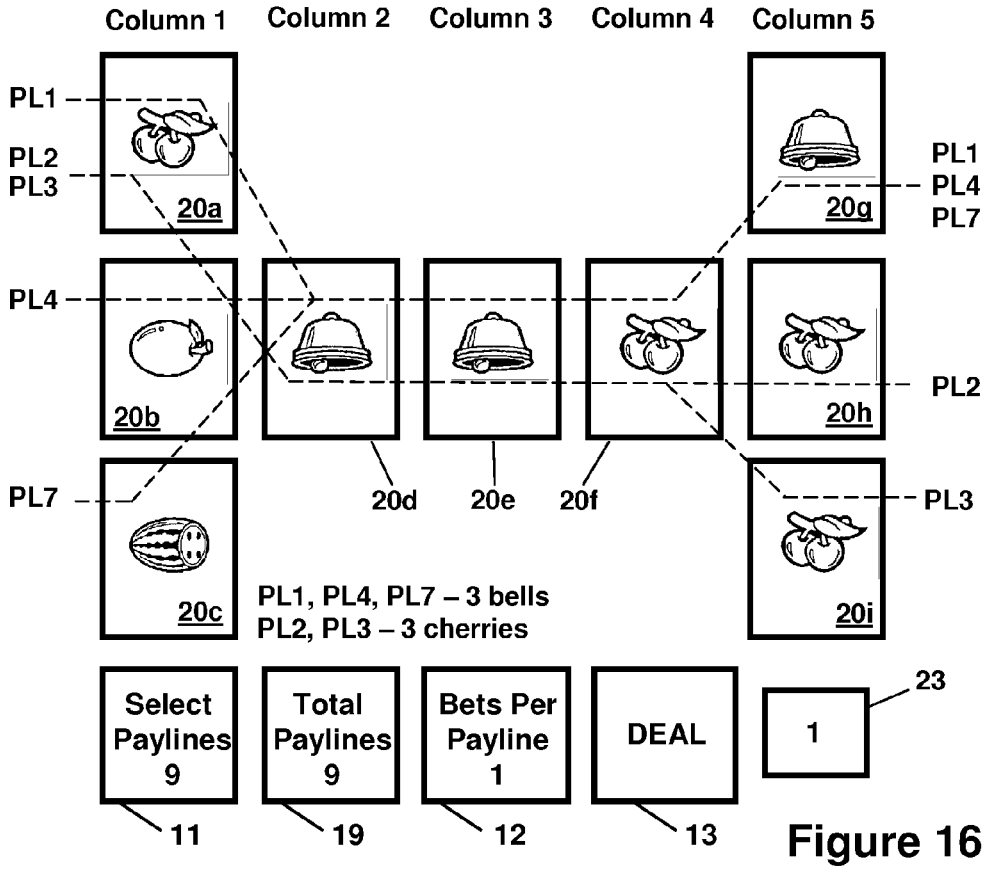
In FIG. 16 is shown a first example of the third type of dynamic pay line game play in which a random number generator has been used to randomly select only the first set of nine pay lines shown in FIG. 13, and showing the winning pay lines for the first example of the game.
Figure 17:
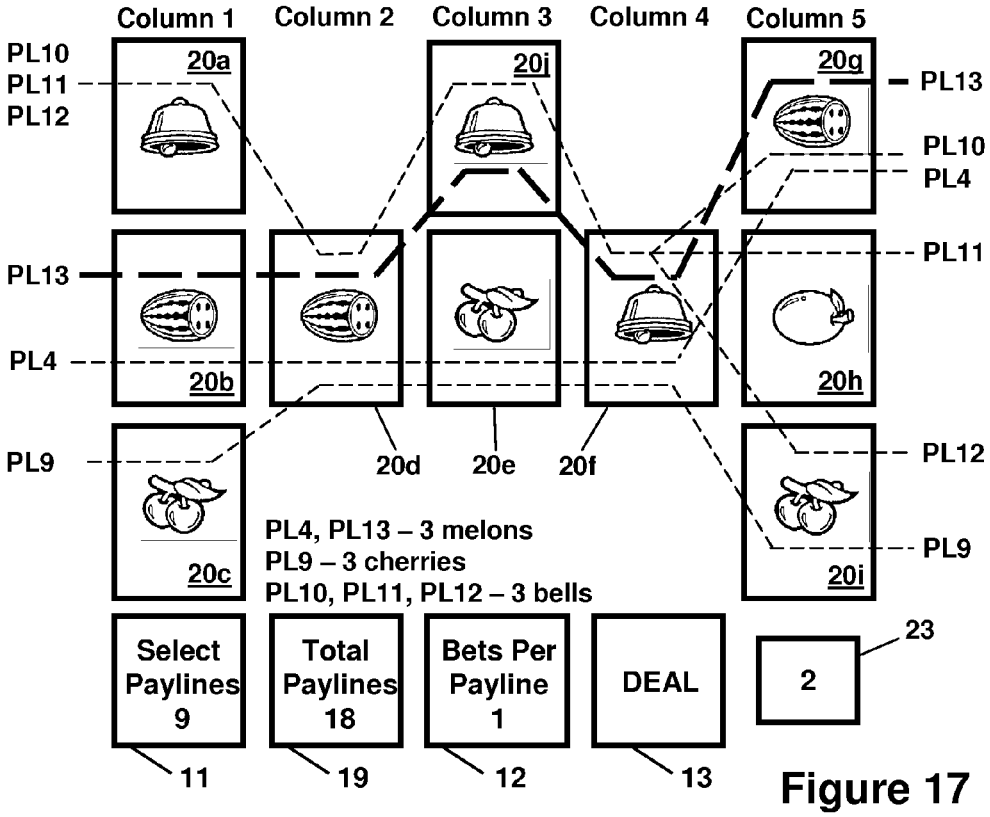
In FIG. 17 is shown a second example of the third type of dynamic pay line game play in which a random number generator has been used to randomly select both the first and second sets shown in both FIGS. 13 and 14, and showing the winning pay lines for the second example of the game.
Figure 18:
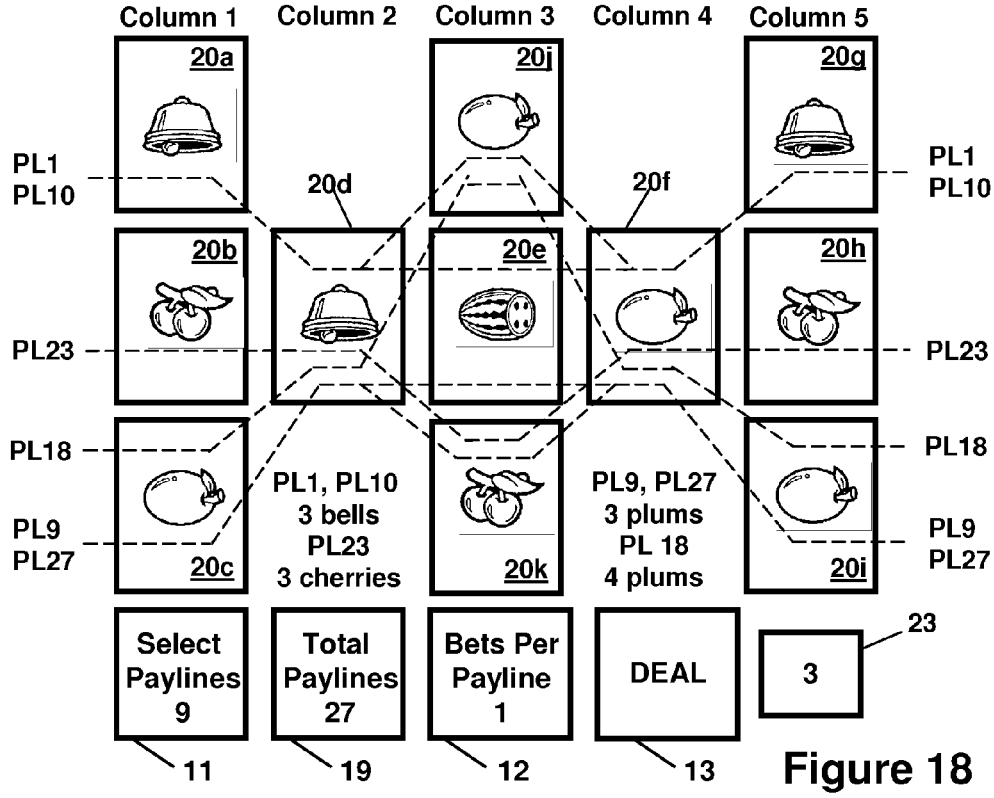
In FIG. 18 is shown a third example of the third type of dynamic pay line game play in which a random number generator has been used to randomly select the first, second and third sets of nine pay lines shown in FIGS. 13, 14 and 15, and showing the winning pay lines for the third example of the game; and In FIG. 19 is shown a 3×5 display matrix used for the preferred embodiment of the invention in which a possible number of bonus pay lines are dynamically determined during the course of game play of slots or cards dependent on choices made by a player during game play.

In accordance with teaching of the third type of dynamic pay line game play the total number of pay lines given to a player for game play is dynamically determined by an event during the course of game play which is the separate random selection of a number between one and three in the examples described hereinafter. A player initially selects a number of hands/pay lines to play between one and nine by touching Select Pay line button 13 (FIGS. 16-18) the appropriate number of times. After they start game play by touching Deal button 13 (FIGS. 16-18), a random selection of the number between one and three is made and is displayed in block 23 (FIGS. 16-18). The number in block 23 indicates that the actual number of pay lines the player has, may be increased up to a factor of three. After the selection of the randomly selected number and its display in block 23, the total number of pay lines the player actually has during game play is displayed in Total Pay lines block 19.

That is, if the player had selected to play nine pay lines and the randomly selected number is "3" the player actually has twenty-seven total pay lines during game play. If the randomly selected number is "2" the player actually has eighteen total pay lines during game play, and if the randomly selected number is "1" the player only has their original nine selected pay lines during game play. The randomly selected number is between the values one and three in the following three examples, but may be expanded using randomly selected numbers in excess of three and the logic for selecting the pay lines can select any sets of the nine, eighteen or twenty-seven pay lines. In addition, the randomly selected number of pay lines may be other than nine, eighteen or twenty-seven pay lines. However, if the player had selected to play four pay lines and the randomly selected number is "3" the player actually has twelve total pay lines during game play. The more hands a player holds the better their chances of winning. In addition, the number of player selected pay lines is described above as being multiplied, but instead the randomly selected number may indicated an additional (added) number of pay lines. Thus, if a player had selected to play three pay lines, and the randomly selected number is three, the player actually has six play lines they are playing.

The following Table 1 shows in tabular form the selection of the total number of pay lines based on the random number generated upon commencement of game play being used as a multiplier.

TABLE 1

| Number of Times "Select Pay lines" Button 11 Operated | | Random Number Generated | | "Total Pay lines" Played |
|---|---|---|---|---|
| 9 | × | 2 | = | 18 |
| 5 | × | 1 | = | 5 |
| 7 | × | 3 | = | 21 |

The following Table 2 shows in tabular form the selection of the total number of pay lines based on the random number generated upon commencement of game play alternatively being added to the number of player selected pay lines. Hereinafter, however, only the randomly selected number used as a multiplier is described.

TABLE 2

| Number of Times "Select Pay lines" Button 11 Operated | | Random Number Generated | | "Total Pay lines" Played |
|---|---|---|---|---|
| 9 | + | 2 | = | 11 |
| 5 | + | 1 | = | 6 |
| 7 | + | 3 | = | 10 |

Referring to Table 1 above, when the player touches the Select Pay line button 11 nine times the number nine is displayed in the button and the player is charged or debited for nine pay lines (hands of cards). For this example the number "2" is randomly generated and displayed in block 23. The number "2" is used as a multiplier and for this round of game play the player actually has (2×9) eighteen pay lines/hands of cards. If the player had instead touched Select Pay lines button 11 five times the number five is displayed in the button. For this second example, if the number "1" is randomly generated the player actually has (1×5) five pay lines/hands of cards. The player has not gained any additional pay lines/hands of cards. Finally, if the player had instead touched Select Pay lines button 11 seven times the number seven is displayed in the button. For this third example, if the number "3" is randomly generated the player actually has (3×7) twenty-one pay lines/hands of cards during game play. Thus, the player's chances of winning have been significantly increased and they are enticed to select more hands to be played. In reality the odds of winning are compensated for in the pay table. Alternatively, the randomly generated number may be added to the player selected number of pay lines/hands of cards as shown in Table 2 above.

In FIGS. 3 through 12 the operation of the third type of dynamic pay line game play is not shown and the number of selected hands equals the number of total hands. However, FIGS. 16-18 all reflect the example in the table above where the player selects and is charged/debited for a number of hands/pay lines, but may receive more hands as reflected by the above Table 1.

The operation of the "Bets Per Hand" button has not been mentioned in the description immediately above, but if the player had selected two bets per hand along with the examples given above any winnings would be doubled. Similarly, if the player had initially selected four bets per hand their winnings would be quadrupled.

Figure 13:
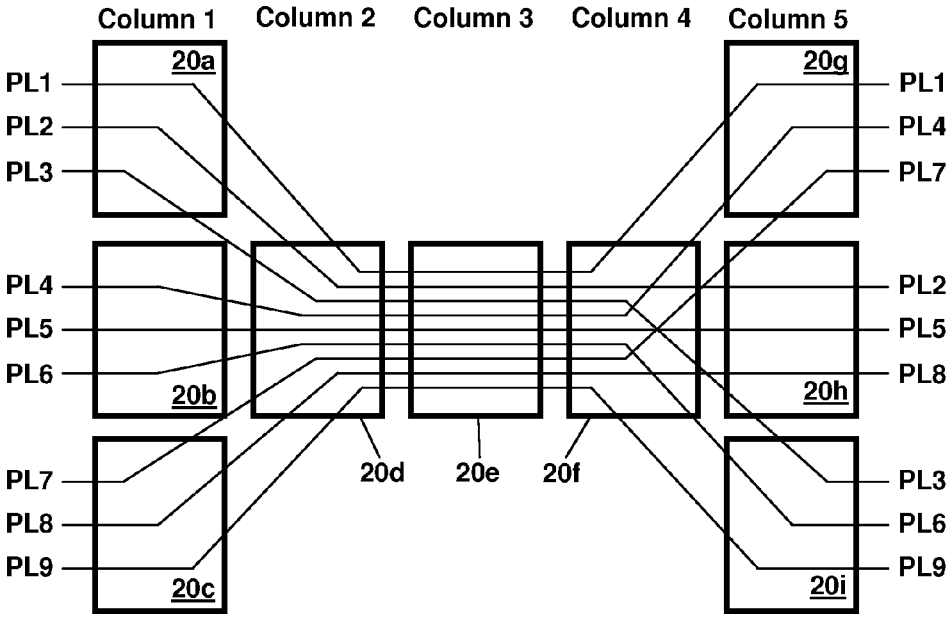
FIG. 13 shows a first set of nine pay lines that are dynamically selected during game play for a third type of dynamic pay line game play.
Figure 14:
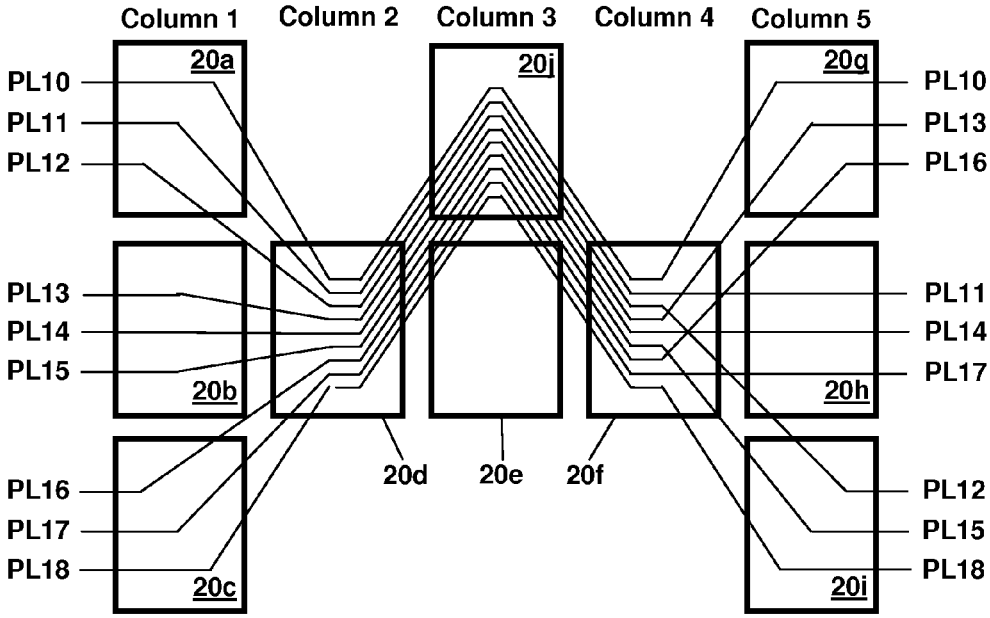
FIG. 14 shows a second, additional set of nine pay lines, yielding a total of eighteen pay lines, that may be dynamically selected during game play for the third type of dynamic pay line game play.
Figure 15:
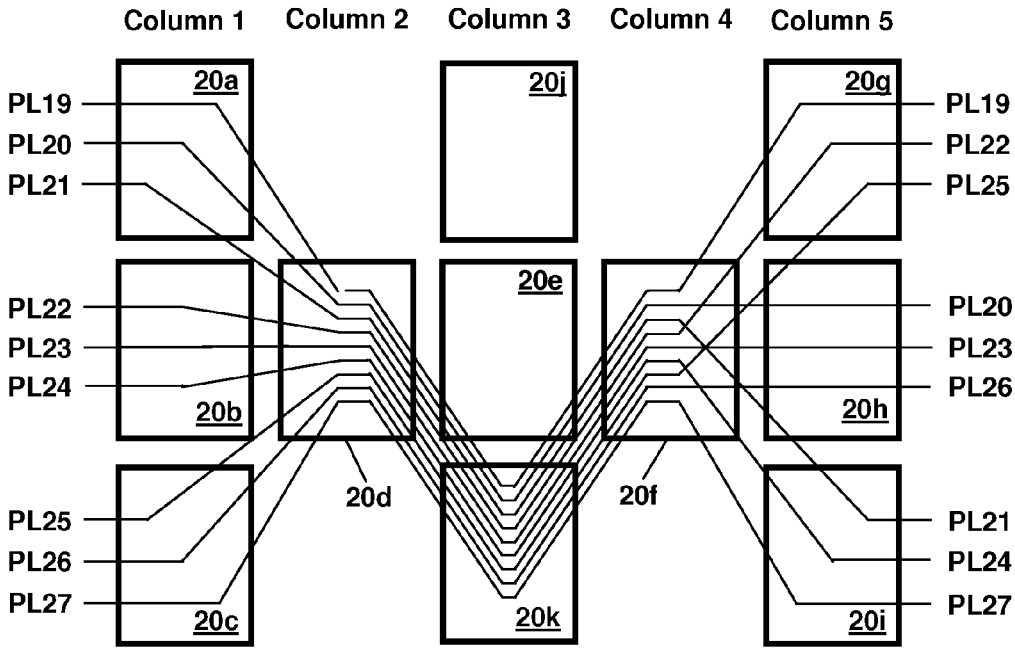
FIG. 15 shows a third, additional set of nine pay lines, yielding a total of twenty-seven pay lines, that may be dynamically selected during game play for the third type of dynamic pay line game play.

In FIGS. 13-15 are shown sets of pay lines that are dynamically selected during the course of game play with a third type of dynamic pay line game play. After a player has selected a number of pay lines to be played, not to exceed nine pay lines, placed their bets and touched Deal button 13 to commence game play, a number between one and three is randomly selected. The randomly selected number causes one or more sets of pay lines in FIGS. 13-15 to be selected for use during game play and thereby multiplies the number of pay lines that a player actually has for any particular round of game play. If the number "1" is randomly selected the player receives no additional pay lines for the game and has only the number of pay lines actually selected by the player to be played. That is, if the player selected to play pay lines PL1-PL9 and the randomly selected number is "1" the player has only pay lines PL1-PL9 to play.

When the number randomly selected after the start of game play is the number "2", the player receives additional pay lines other than those equal to the number of pay lines selected to be played. If the player had initially selected to play five pay lines they will get pay lines PL1-PL5 from set one in FIG. 13 and will get pay lines PL10-PL15 from set two in FIG. 14. If the player had initially selected to play nine pay lines they will get pay lines PL1-PL9 from set one in FIG. 13 and will get nine additional pay lines PL10-PL18 from set two in FIG. 14.

When the number randomly selected after the start of game play is the number "3", the player again receives additional pay lines other than the number of pay lines selected to be played. The player has pay lines from the sets shown in FIGS. 13, 14 and 15, up to a maximum of 27 pay lines. If the player had initially selected to play nine pay lines they will get the nine pay lines PL1-PL9 from set one in FIG. 13, will also get the nine pay lines PL10-PL18 from set two in FIG. 14, and will also get nine pay lines PL19-PL27 from set three in FIG. 15.

More particularly, the game playing field for the third type of dynamic pay line game play has a basic "H" shape comprised of display positions 20*a*-20*i* as shown in FIG. 13. Nine pay lines PL1-PL9 are shown. When a player initially selects to play three pay lines they will get pay lines PL1-PL3. When a player initially selects to play seven pay lines they will get seven pay lines PL1-PL7, and so on up to nine pay lines. However, the number of pay lines the player actually has is determined by events occurring during the course of game play. That event is the random selection of a number between "1" and "3" after the player has touched a Deal button 13. For example, the player will initially choose five pay lines before the start of game play, but after the start of game play they may actually have 5, 10 or 15 pay lines. The more pay lines they have the greater the chance of having winning pay lines. However, the increased odds of winning are compensated for in the pay table for the game.

If, after a player has selected a number of pay lines to be played and has started game play by touching the Deal button 13, and the number "2" is randomly selected and displayed in block 23, the game play display field will have display position 20*j* added thereto, as shown in FIG. 14, and another card is dealt into this position. This is described for the game example shown in FIG. 17. Up to nine additional pay lines will pass through display position 20*j* as shown on FIG. 14.

If, after a player has selected a number of pay lines to be played and has started game play by touching the Deal button 13, and the number "3" is randomly selected, the game play display field will have another display position 20*k* added thereto (in addition to display position 20*j*), as shown in FIG. 15, and another card is dealt into position 20*k*. This is described for the game example shown in FIG. 18. Up to nine additional pay lines will pass through display position 20*j* as shown on FIG. 15.

In FIG. 16 is shown a first example of the third type of dynamic pay line game play in which a random number generator is used to dynamically generate a first number that yields the actual number of pay lines a player is playing. In this first example the number "1" is randomly selected by the game program and is displayed in position 23 so no additional card display positions (20*j* or 20*k*) are added to the basic game playing field. For this first example the player initially selects to play nine pay lines by touching Select Pay Lines button 11 nine times and the number nine is displayed in button 11 as shown. For this first example the player only places one bet per pay line as represented by the number one displayed in Bets Per Pay line display 12. The player then touches Deal button 13 to commence game play. Since the randomly selected number is "1" the player receives no additional pay lines and has only the nine pay lines initially selected. Thus, the number nine is also displayed in Total Pay lines block 19, FIG. 16. In a manner known in the art the five reels shown respectively in matrix columns 1-5 have slot symbols randomly displayed therein as shown.

The slot symbols displayed in FIG. 16 along each of the nine pay lines shown in FIG. 13 are then automatically analyzed to determine if there are any winning combinations of slot symbols. In this first example there are winning combinations along pay lines PL1 through PL4 and PL7. Each of the winning pay lines are shown as dashed lines through the display matrix with the winning pay line identity shown at either end of the pay lines. It can be seen that pay lines PL1, PL4 and PL7 each have three bells; and pay lines PL2 and PL3 each have three cherries. The winning pay lines are listed on the display in FIG. 16. A pay table (not shown) is used to determine what winnings a player has in a manner well known in the art. For the sake of simplicity only, pay lines PL1, PL4 and PL7 are not shown as three completely separate pay lines, but are shown combining in column 2 and going in common to display position 20*g* in column 5.

In FIG. 17 is shown a second example of the third type of dynamic pay line game play in which a random number generator is used to generate a number after the start of game play that dynamically yields the actual number of pay lines a player is playing. For this second example the player initially selects to play nine pay lines by touching Select Pay Lines button 11 nine times and the number nine is displayed in button 11 as shown. In addition, the player only places one bet per pay line as represented by the number one displayed in block 12. The player then touches Deal button 13 to commence game play. In this second example the number "2" is randomly selected after the start of game play, as shown in block 23, so an additional slot symbol display position 20*j* is added to the game playing field as shown. The player initially started with nine pay lines but now has eighteen pay lines; the nine pay lines shown in each of FIGS. 13 and 14. In a manner known in the art the five reels shown respectively in matrix columns 1-5 each have slot symbols randomly generated and displayed in positions 20*a*-20*j* as shown.

The slot symbols displayed in FIG. 17 along each of the nine pay lines shown in FIG. 13 and along each of the nine pay lines shown in FIG. 14 are then automatically analyzed to determine if there are any winning combinations of slot symbols. In this second example there are winning combinations along pay lines PL4 and PL9-PL13 that are displayed in FIG. 17. Each of the winning pay lines are shown as dashed lines through the slot display matrix with the pay line identity displayed at either end of each line. It can be seen that pay lines PL4 and PL13 each have three melons, pay line 9 has three cherries, and pay lines PL10-PL12 each have three bells. The winning pay lines are listed on the display in FIG. 17. A pay table (not shown) is used to determine what winnings a player has in a manner well known in the art. For the sake of simplicity only, pay lines PL10, PL11 and PL12 are not shown as three completely separate pay lines, but are shown in common passing through columns 1-4 and splitting in column 5.

When many pay lines zig-zag through the game matrix it is often hard to tell which displayed slot symbols a pay line passes through. In a typical 3×5 game matrix, there are $3^5$ (243) possible pay lines. The bet pay lines used are usually the more convenient and symmetric lines such as horizontal or "V" or "^" lines. Player confusion on which or why a pay line won or why a seeming win didn't pay (win combination not on a bet line) is common place. In this non-typical matrix of symbols, every possible combination of pay line for the symbols present is a valid pay line. Thus any need to distinguish between bet and non-bet pay lines is not necessary.

In FIG. 18 is shown a third example of the third type of dynamic pay line game play in which a random number generator is used to dynamically generate a number that yields the actual number of pay lines a player is playing. For this third example the player initially selects to play nine pay lines by touching Select Play Lines button 11 nine times and the number nine is displayed in button 11 as shown. In addition, the player only places one bet per pay line as represented by the number one displayed in button 12. The player then touches Deal button 13 to commence game play. For this third example the random number generator then selects the number "3", as displayed in block 23, so both the additional display positions 20*j* and 20*k* are displayed. The player initially started with nine selected pay lines but now has twenty seven pay lines; the nine pay lines shown in each of FIGS. 13, 14 and 15. In a manner known in the art the five reels shown respectively in slot matrix columns 1-5 have slot symbols randomly selected and displayed therein as shown. All twenty seven pay lines (PL1-PL27) in FIGS. 13-15 are reviewed against the slot symbols shown in FIG. 18 to determine what the winning slot symbol combinations there are. Only winning pay lines are displayed in FIG. 18 for simplification. Displaying all 27 pay lines would create a visual mess.

In this third example of the third type of dynamic pay line game play there are winning combinations along pay lines PL1, PL9, PL10, PL18, PL23 and PL27. Each of the winning pay lines are shown as dashed lines through the display matrix with the pay line identity shown at either end of each pay line. It can be seen that pay lines PL1 and PL10 each have three bells, pay line 23 has three cherries, pay lines PL9 and PL27 each have three plums, and pay line 18 has four plums. The winning pay lines are listed on the display in FIG. 18. A pay table (not shown) is used to determine what winnings a player has in a manner well known in the art. Although not shown in FIG. 18 a player may highlight individual winning pay lines by touching any one of the winning pay line designations along the right or left edge of the matrix. The selected pay line will be changed to a bright color and will blink to make it easy to view the cards making up the hand along the selected pay line.

For the sake of simplicity only, pay lines PL1 and PL10, and pay lines PL9 and PL27 are not shown as completely separate pay lines, but portions of the pay lines are shown in common passing through the columns. Pay lines PL1 and PL10 start out passing through the same slot symbols in display positions 20*a* and 20*d*, split as they pass through different symbols in positions 20*e* and 20*j*, before passing through the common symbols in positions 20*f* and 20*g*. Similarly, pay lines PL9 and PL27 pass through common display positions 20*c* and 20*d*, split to go through different display positions 20*e* and 20*k* in column 3, and rejoin and commonly go through common display positions 20*f* and 20*i*.

In FIGS. 16-18, the number between one and three randomly picked at the start of game play is displayed to the player in display block 23. To avoid congestion in the drawing only, no other designation is shown in or with block 23.

FIGS. 19-23 depict the preferred embodiment of the invention in which extra bonus pay lines are dynamically awarded dependent on choices made by a player during game play. While the preferred embodiment of the invention may be utilized with either a 3×5 matrix electronic slot game or a 3×5 matrix electronic card game, such as draw poker, only the draw poker card game version is described herein. The preferred embodiment has player-initiated events. It uses the player initiated event of initiating the "Deal" of a hand of cards, which is well known in the game of draw poker, and involves chance discovery of stores of extra bonus pay lines which are given to the player when found.

Multiple figures are needed to fully understand the preferred embodiment of the invention because the quantity of additional or "bonus" pay lines that may be awarded to a player vary depending on when they are awarded to a player during a plurality of rounds of game play. FIGS. 20-23 are used for this purpose. The more rounds of game play that are played, the higher the number of bonus pay lines that may be awarded to a player. This will be better understood upon reading further in this Detailed Description, particularly with reference to FIGS. 24 and 25. FIGS. 24 and 25 are used to describe the algorithm used to dynamically determine the number of additional or bonus pay lines awarded to a player responsive to selections they make during the course of multiple rounds of game play. Thus, the player has an incentive to play more rounds of the card game since the number of bonus pay lines increases as they play more games in a sequential fashion.

FIGS. 20-23 each depict one round of game play of draw poker with the implementation of the preferred embodiment of the invention overlaid on a themed slot game. It should be noted that all the embodiments presented so far use a 3×5 matrix but would work on any size matrix e.g. 3×4 or 3×3 or 5×5 etc. It is also worth noting that the invention involves events, which span a plurality of rounds of game play.

Figure 19:
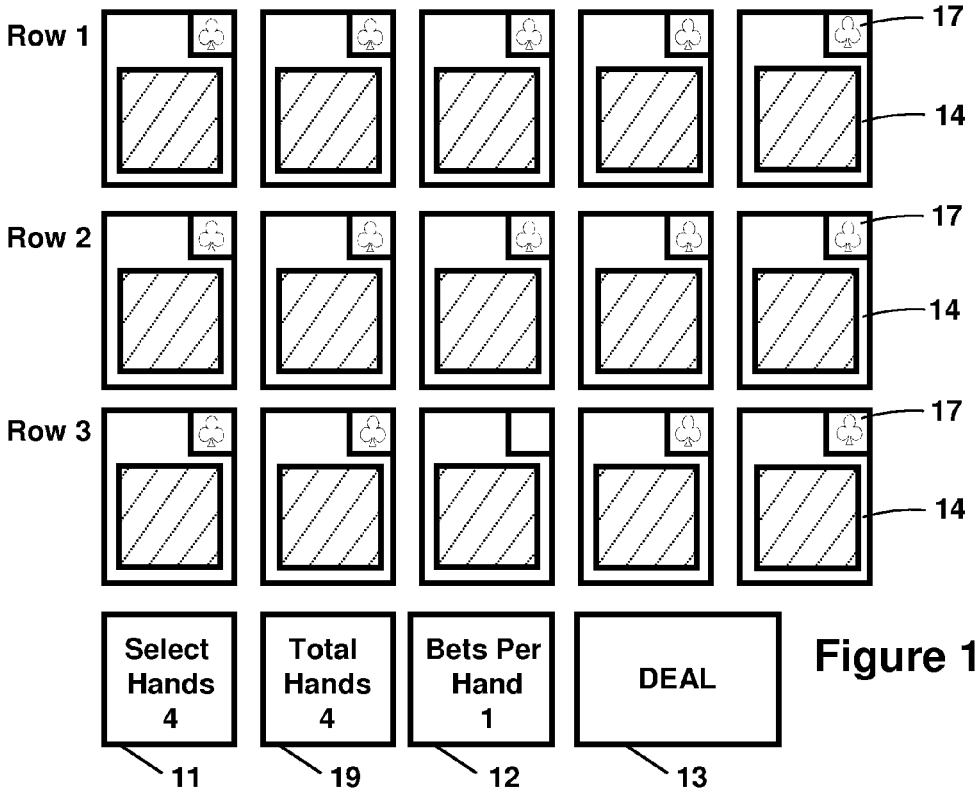

FIG. 19 shows a 3×5 display matrix used for the preferred embodiment of the invention. The matrix is similar to other slot or card game matrices. To implement the invention onto the slot game each of the fifteen card display positions 14 in the 3×5 display matrix has a small block 17 therein in which is initially displayed a first indicia. The fifteen first indicia shown in FIG. 19 are shamrocks and under predetermined ones of the fifteen shamrocks is a second indicia indicating that the player has been awarded additional pay lines for that round of game play. Typically there may be three of the second indicia hidden under randomly selected ones of the fifteen shamrocks as described with reference to FIG. 25. However, there may be two second indicia as used for the simpler example described with reference to FIGS. 20-24, or there may be more than three second indicia. At the start of each round of game play a player randomly touches one of the fifteen shamrocks in an attempt to find one of the second indicia so that they will be awarded additional or bonus pay lines for that round of game play. Thus, if a player selects to play nine hands of cards (nine pay lines), as shown in Select Hands block 11, and touches a shamrock to discover that they have been awarded four bonus pay lines, Total Hands block 19 will then read "13". At the end of each round of play, if the uncovered shamrock does not reveal a secondary indicia, i.e. no bonus pay lines are awarded, the amount of bonus pay lines may or may not be increased and the uncovered shamrock is not replaced, i.e. the next round has one less shamrock to chose among, thus increasing the player's odds. If the uncovered shamrock reveals a second indicia then the player is awarded the bonus pay lines indicated by the secondary indicia, and the play continues with the original player chosen pay lines plus the awarded bonus pay lines. At the end of a series of game play, after all second indicia have been found by the player, all the shamrocks are restored, the pre-determined number of secondary indicia are randomly re-hidden under the fifteen shamrocks and the game is reset to a minimal number of bonus pay lines. This play-by-play increase in the number of pay lines in the secondary indicia is supported by the pay table.

In FIGS. 20-23 each of the second indicia is a number indicating a number of bonus pay lines that a player is awarded. These numbers are hidden under randomly selected ones of the shamrocks in first indicia blocks 17. However, other indicia may be displayed in lieu of a number. The number of bonus pay lines awarded to a player is typically indicated only in Total Hands block 19. As mentioned above, in the simple example described with reference to FIGS. 20-23, only two of the shamrocks displayed in the fifteen positions 17 of the matrix have a number hidden under a shamrock. These are designated Bonus A and Bonus B respectively and one such Bonus will be located by the player before the other. FIG. 24 shows a table indicating how the hidden numbers are dynamically determined during the course of game play based on the number of rounds of game play that have been played and responsive to selections made by the player during the course of the multiple rounds of game play.

Figure 20:
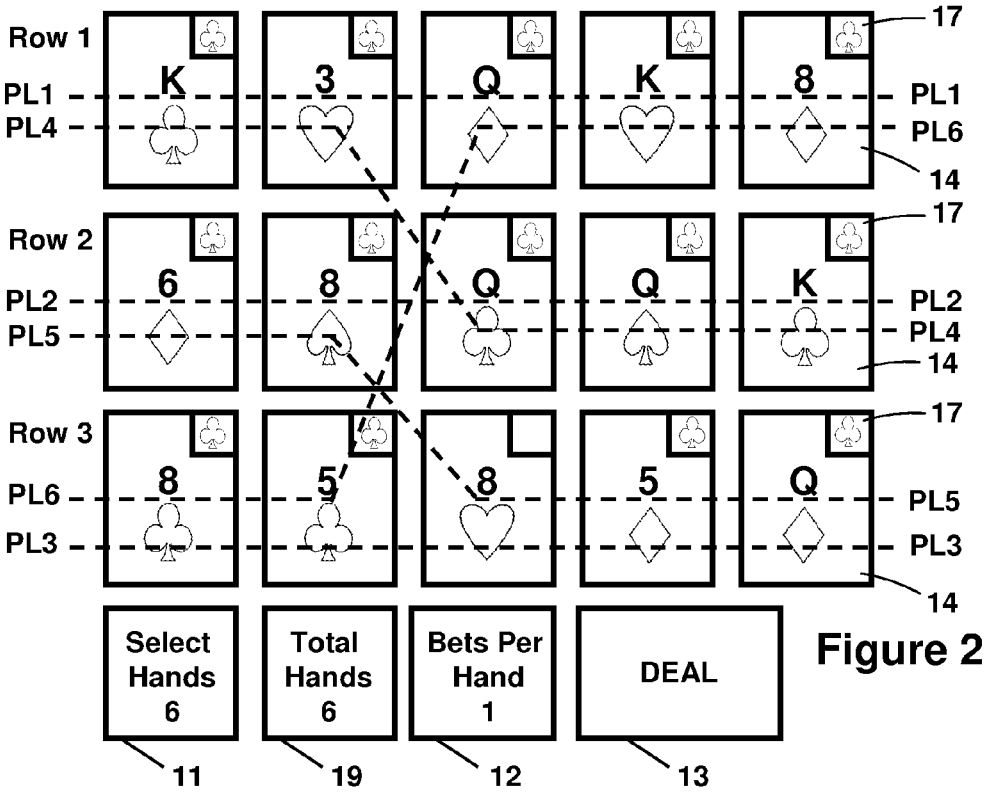
In FIG. 20 is shown a first round of game play of cards implementing the preferred embodiment of the invention.

Turning now to FIG. 20, at the beginning of the first round the player has selected to play six pay lines of game play as indicated in Select Hands Block 11. These six lines designated PL1-PL5 are fixed in position and order of appearance as is well known in the art. In FIG. 24, for game round 1, the A bonus corresponding to the first of the two secondary indicia shows the number "2" and the B bonus corresponding to the second indicia also shows the number "2". The player touches the shamrock in Row 3, column 3 of the 3×5 display matrix. The game program in conjunction with the touch screen senses the touch and removes the shamrock in this matrix position. Alternatively, if the player chooses to touch the Deal button (block 13) instead of a shamrock, the game selects a shamrock randomly for the player. The uncovered shamrock shows no second indicia number displayed there under indicating additional pay lines for either Bonus A or Bonus B. With no bonus pay lines the number "6" displayed in Total Hands block 19 remains at the number "6". For this first round of game play the player selected six pay lines PL1-PL6 which are displayed and any winning hands along these six pay lines are determined in a manner well known in the art. The winning pay lines and the player's winnings are not shown or described further to avoid detracting from the description of the invention.

At the end of this first round of game play, both Bonus A and Bonus B in FIG. 24 are incremented by two pay lines to four and four respectively as shown in FIG. 24. To remind the player of what indicia display positions 17 have previously been selected in the 3×5 display matrix, once a position is selected by a player and the displayed shamrock is removed, a shamrock is not again displayed in the position until after all hidden bonus pay line numbers have been found.

Figure 21:
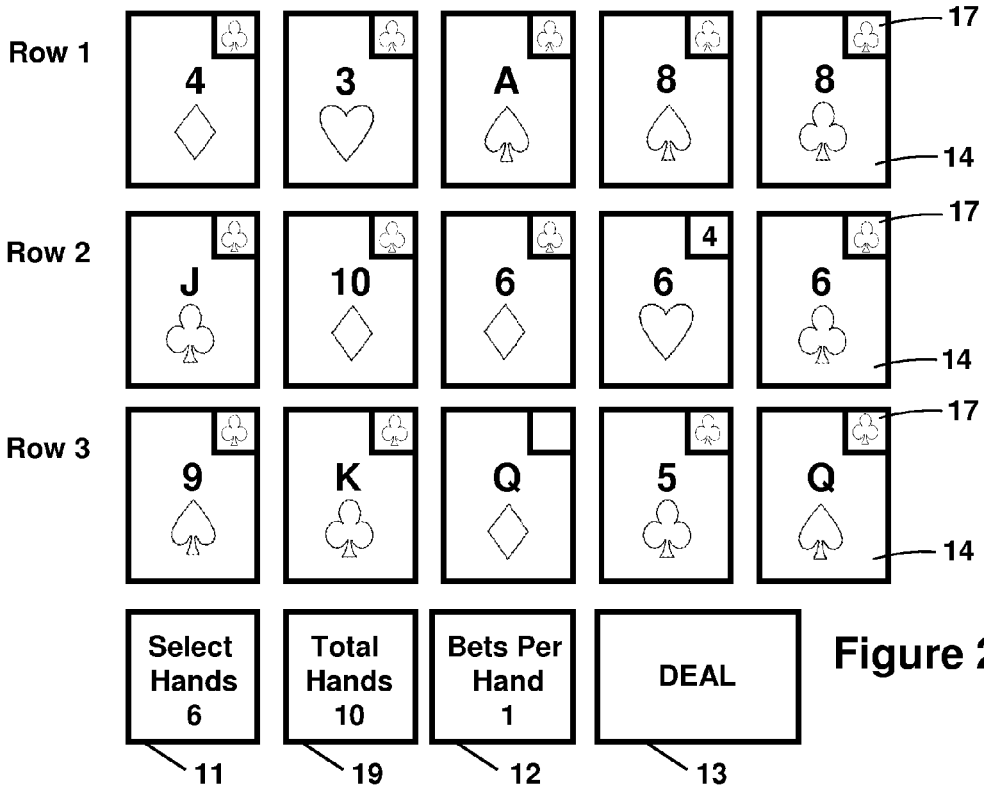
In FIG. 21 is shown a second round of game play of cards implementing the preferred embodiment of the invention.

In FIG. 21 is shown the second round of game play, but without the final pay lines as shown in FIG. 20. To start the game play the player selects and touches the shamrock in Row 2, Column 4 of the 3×5 display matrix. The game program in conjunction with the touch screen senses the touch and removes the shamrock in this position. Since this position is that of Bonus B the number "4" is displayed indicating that the player has been awarded four Bonus B pay lines. This increase is shown in Total Hands block 19 which changes from "6", the number of hands initially chosen by the player, to the number "10" reflecting the addition of the four Bonus B pay lines. The additional bonus pay lines PL7-PL10 (not shown) are generated dynamically, are different from PL1-PL6 (not shown) and all go through the player selected position at Row 2, Column 4. The winning hands of cards along the ten pay lines are determined in a manner well known in the art. The winning pay lines and the player's winnings are not shown or described further to avoid detracting from the description of the invention. They would be similar to that shown in FIG. 20.

At the end of round 2, Bonus A is incremented by two pay lines to six and Bonus B is reset to two pay lines as shown in the appropriate columns of FIG. 24. Bonus B was decremented by four to zero and then incremented to two going into game round 3, as shown in FIG. 24, but the amount shown is grayed out (as represented by the light lines in FIG. 24) indicating that its secondary indicia has not been replaced and won't be replaced till after Bonus A is found. The use of multiple secondary indicia is useful in that as one Bonus is found (A or B), awarded and reset to zero, the other Bonuses have advanced to an amount which is attractive to the player.

Figure 22:
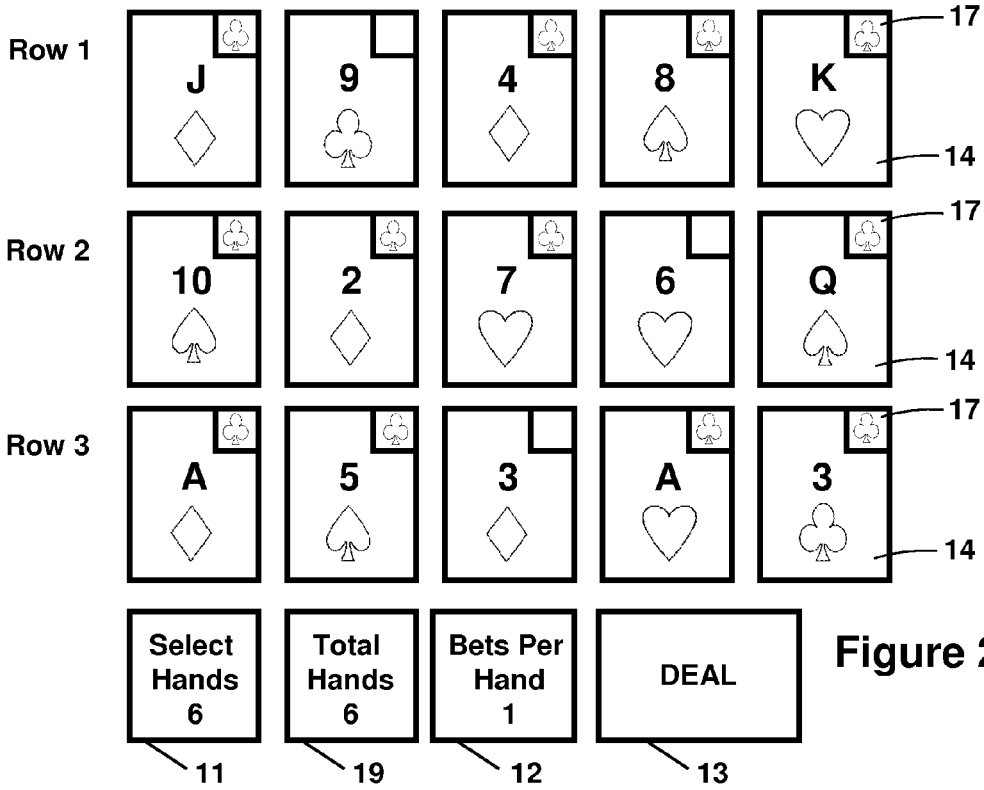
In FIG. 22 is shown a third round of game play of cards implementing the embodiment of the invention.
Figures 23, 24:
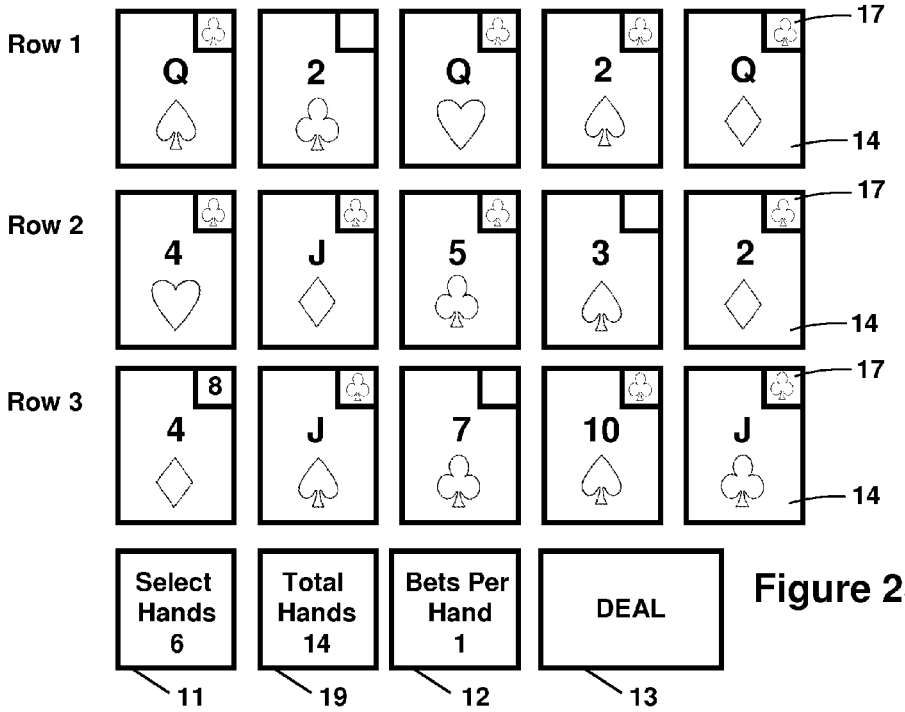
In FIG. 23 is shown a fourth round of game play of cards implementing the embodiment of the invention.
In FIG. 24 is a table showing in a contracted form how bonus pay lines are determined and awarded to a player during the course of game play of cards; and In FIG. 25 is a table showing how bonus pay lines are determined and awarded to a player during a normal course of game play of cards.

In FIG. 22 is shown the beginning of the third round of play. During Round 3 game play, the player selects and touches the shamrock in Row 1, column 2 in the 3×5 display matrix. The game program in conjunction with the touch screen senses the touch and removes the shamrock in this position. There is no number displayed indicating any bonus pay lines. The player has only the six pay lines they selected to play as indicated in Select Hands Block 11. With no bonus pay lines the number six is also displayed in Total Hands block 19. For this third round of game play the winning hands are determined in a manner well known in the art. The winning pay lines and the player's winnings are not shown or described further to avoid detracting from the description of the invention. They would be similar to that shown in FIG. 20. To remind the player that they have selected Row 1, column 2 in the 3×5 display matrix, the shamrock is not again displayed in that position until after all hidden bonus pay line numbers have been found. In this instance only Bonus A remains to be found. At the end of this round, both bonus A and B are incremented by two pay lines to eight and four respectively as shown in FIG. 24.

In FIG. 23 is shown the drawn hand at the beginning of the fourth round of play. During game play the player selects and touches the shamrock in Row 3, column 1 in the 3×5 display matrix. The game program in conjunction with the touch screen senses the touch and removes the shamrock in this position. The number "8" is displayed in this position indicating that the player has been awarded eight bonus pay lines. This is seen in the table in FIG. 24. This increase is reflected in Total Hands block 19 which changes from "6", the number of hands initially chosen by the player, to the number "14" reflecting the addition of the eight bonus pay lines. The winning hands of cards along the fourteen pay lines are determined in a manner well known in the art. The winnings pay lines and the player's winnings are not shown or described to avoid detracting from the description of the invention. They would be similar to that shown in FIG. 20. Although not shown in FIG. 23, the eight bonus pay lines PL7-PL14 are dynamically generated to be different from pay lines PL1-PL6 and are routed through Row 3, column 1 in the 3×5 display matrix, the player selected position. The exact routing of the additional, bonus pay lines may be different and still remain within the teaching of the invention.

With Bonus A number having been located, the number of Bonus A pay lines is decremented by eight to zero, and then is incremented by two, as shown in the Bonus A Pay Lines column of FIG. 24. The number of Bonus B Pay Lines is also incremented by two to a total of six bonus pay lines as also shown in FIG. 24.

After Round 4 of game play is completed both Bonus pay line numbers have been located. At this time shamrocks are again displayed in all fifteen positions 17 in the 3×5 display matrix and two new positions 17 are picked for hidden bonus pay line numbers. The above described sequence of operations described with reference to FIGS. 20-23 is repeated with the only difference being that the next, plural rounds of game play commence with Bonus A having the value of 2 and Bonus B having the value 6, both as shown in FIG. 24.

In FIG. 25 is shown a table that represents how a bonus pay line algorithm dynamically determines additional, bonus pay lines during the course of multiple rounds of game play shown in FIGS. 20-23 based on the number of rounds of game play and responsive to selections made by the player during the course of the multiple rounds of game play. The rounds of game play depicted in FIGS. 20-23, and shown in FIG. 24 are a short version of the operation of the invention to minimize the number of Figures involved. With the operation of the invention being understood with reference to FIGS. 20-24 only the table in FIG. 25 is needed to understand a more protracted description of the operation as is experienced in actual operation over a larger number of rounds of game play.

Across the top of the table in FIG. 25 are the column headings "Bonus A Pay Lines", "Bonus B Pay Lines" and "Bonus C Pay Lines" indicating first that there are three of the fifteen shamrocks in positions 17 of the 3×5 game display matrix under which will be indicated bonus pay lines. More importantly, the numbers in these three columns of the table show how the number of bonus pay lines change dynamically during the course of ten rounds of game play, dependent on when and which shamrocks are chosen by the player, and the player choices dynamically effect future game play pay lines.

The third column heading at the top of the table in FIG. 25 is "Bonus Hit" indicating during which round of game play a player has selected a shamrock under which is a number indicating a number of bonus pay lines. It indicates which of the Bonus pay lines (A, B and C) has been found during a round of game play by displaying the appropriate one of the letters "A", "B" or "C". The fourth column heading is "Played Pay Lines" and indicates the number of pay lines selected by a player to be played prior to a round of game play. In each of the ten rounds of game play depicted in FIG. 25 the player always selects to play six hands of cards or pay lines, but this is only done for the sake of simplicity. The player may select to play a different number of hands for each round of game play. The fifth column heading is entitled "Total Pay Lines" and indicates the total number of player selected pay lines plus any bonus pay lines won by the player. If a player has been awarded six bonus pay lines, with their originally selected six pay lines they have a total of twelve pay lines for a round of game play.

On the left side of the table in FIG. 24 are listed Round 1 through Round 10 alongside ten rows for ten rounds of game play.

With this understanding of the organization of the table in FIG. 25 with respect to game play, the progression through ten rounds of game play is described with three Bonus numbers (A, B and C). The player plays six pay lines for each of the ten rounds of game play as indicated by the number "6" throughout the Played Pay Lines column.

Prior to the start of the first round of game play (Round 1) the number of bonus pay lines for Bonus A, Bonus B and Bonus C are incremented to two as shown in the first row entitled Round 1. This is done so that if the player selects a hidden bonus pay line position in the display matrix during Round 1 they will receive a minimum of two bonus pay lines.

A player is now ready to play the first round of game play (Round 1) in accordance with the teaching of the invention. After selecting a number of hands to play the player touches Deal button 13 to start Round 1 of game play. Thereafter, the player touches one of the fifteen display positions in an attempt to find one of the three Bonus A through Bonus C bonus numbers. In this description of game play the player does not pick a matrix position with a bonus number behind the shamrock during Round 1. This is indicated by the "0" in the Bonus Hit column in the Round 1 row of the table. The player initially selected "6" pay lines as described above, and with no received bonus pay lines the player has a total "6" pay lines for determining winnings at the end of the first round of game play. This is reflected in the last column of the Round 1 row of the table entitled "Total Pay Lines" which also reads "6".

At the end of Round 1 of game play the number of bonus pay lines for Bonus A through Bonus C is incremented by two. Thus, the number "4" is shown in the first three columns of the Round 2 row of the table. The number "2" which was previously hidden by the game program under the Bonus A through Bonus C positions in the 3×5 display matrix is now increased to the number "4". Thus, over multiple rounds of game play the player receives more bonus pay lines and this is a great incentive to continue playing.

The player is now ready to play Round 2 of game play in accordance with the teaching of the invention. After selecting a number of hands to play the player touches Deal button 13 to start Round 2 of game play. Thereafter, the player touches another of the remaining fifteen display positions in an attempt to find one of the three Bonus A through Bonus C bonus numbers. In this second round of game play the player does not pick a matrix position with a bonus number behind the shamrock. This is indicated by the "0" in the Bonus Hit column in the Round 2 row of the table. The player initially selected "6" pay lines and with no received bonus pay lines the player has a total "6" pay lines for determining winnings at the end of the second round of game play. This is reflected in the last column of the Round 2 row of the table entitled "Total Pay Lines" which also reads "6".

At the end of Round 2 of game play the number of bonus pay lines for Bonus A through Bonus C is incremented by two. Thus, the number "6" is shown in the first three columns of the third row (Round 3) of the table. The number "4" which was previously hidden by the game program under the Bonus A through Bonus C positions in the 3×5 display matrix is now increased to the number "6". Thus, over multiple rounds of game play the player receives more bonus pay lines and this is a great incentive to continue playing.

The player is now ready to play Round 3 of game play in accordance with the teaching of the invention. After selecting a number of hands to play the player touches Deal button 13 to start Round 3 of game play. Thereafter, the player touches another of remaining the fifteen display positions in an attempt to find one of the three Bonus A through Bonus C bonus numbers. In this description the player does not pick a matrix position with a bonus number behind the shamrock during Round 3. This is indicated by the "0" in the Bonus Hit column in the third row (Round 3) of the table. The player initially selected "6" pay lines as described above, and with no received bonus pay lines the player has a total "6" pay lines for determining winnings at the end of the first round of game play. This is reflected in the last column of the third row of the table, entitled "Total Pay Lines", which also reads "6".

At the end of Round 3 of game play the number of bonus pay lines for Bonus A through Bonus C is incremented by two. Thus, the number "8" is shown in the first three columns of the Round 4 row of the table. The number "6" which was previously hidden by the game program under the Bonus A through Bonus C positions in the 3×5 display matrix is now increased to the number "8". Thus, over multiple rounds of game play the player receives more bonus pay lines and this is a great incentive to continue playing.

The player is now ready to play Round 4 of game play in accordance with the teaching of the invention. After selecting a number of hands to play the player touches Deal button 13 to start Round 3 of game play. Thereafter, the player touches another of remaining the fifteen display positions in an attempt to find one of the three Bonus A through Bonus C bonus numbers. The player this time picks a matrix position with the Bonus B number "8" behind the shamrock. This is indicated by the "B" in the Bonus Hit column in the fourth row (Round 4) of the table in FIG. 25. The player initially selected "6" pay lines as described above, and with the "8" bonus pay lines the player has a total "14" pay lines for determining winnings at the end of round four of game play. This is reflected in the last column of the fourth row of the table, entitled "Total Pay Lines", which reads "14".

At the end of Round 4 of game play the number of bonus pay lines for Bonus A through Bonus C is incremented by two. The Bonus B pay lines were decremented to zero when the player won them in Round 3 of game play, but is incremented by two going into Round 5, so "2" shows under Bonus B Pay Lines for Round 5. The number "8", which was the previous number of Bonus A and Bonus C pay lines now reads "10" pay lines. The player cannot again select and find a number of bonus pay lines for Bonus B until after the still hidden Bonus A and Bonus C pay lines are found.

The player is now ready to play Round 5 of game play in accordance with the teaching of the invention. After selecting a number of hands to play the player touches Deal button 13 to start Round 3 of game play. Thereafter, the player touches another of the fifteen display positions in an attempt to find one of the remaining Bonus A or Bonus C bonus numbers. In the description of game play with reference to FIG. 25, the player does not pick a matrix position with a bonus number behind the shamrock during Round 3. This is indicated by the "0" in the Bonus Hit column in the fifth row (Round 5) of the table. The player initially selected "6" pay lines as described above, and with no received bonus pay lines the player has a total "6" pay lines for determining winnings at the end of the first round of game play. This is reflected in the last column of the fifth row of the table, entitled "Total Pay Lines", which also reads "6".

At the end of Round 5 of game play the number of bonus pay lines for Bonus A through Bonus C is incremented by two. Thus, the number "12" is shown in the first and third columns of the fifth row (Round 5) of the table, and the number "4" is shown the second column.

The player is now ready to play Round 6 of game play in accordance with the teaching of the invention. After selecting a number of hands to play the player touches Deal button 13 to start Round 6 of game play. Thereafter, the player touches another of the remaining fifteen display positions in an attempt to find one of the remaining Bonus A or Bonus C bonus numbers. The time the player picks a matrix position with the Bonus A number "12" behind the shamrock. This is indicated by the "A" in the Bonus Hit column in the sixth row (Round 6) of the table in FIG. 25. The player initially selected "6" pay lines as described above, and with the "12" bonus pay lines the player now has a total "18" pay lines for determining winnings at the end of Round 6 of game play. This is reflected in the last column of the sixth row of the table, entitled "Total Pay Lines", which reads "18".

At the end of Round 6 of game play the number of bonus pay lines for Bonus A through Bonus C is incremented by two. The Bonus A pay lines were decremented to zero when the player won them in Round 6 of game play, but the number is incremented by two going into Round 7, so "2" shows under Bonus A Pay Lines for Round 7. The number of Bonus B pay lines is incremented to "6", and the number of Bonus C pay lines is incremented to "14". The player cannot again select and find a number of bonus pay lines for Bonus A until after the remaining Bonus C pay lines are found.

During Rounds 7 and 8 of game play the player does not pick a display matrix position under which the Bonus C number is hidden so the number of Bonus A through Bonus C pay lines are incremented by two during each of these two rounds of game play. Going into the ninth round (Round 9) of game play there are six Bonus A pay lines, ten Bonus B pay lines and eighteen Bonus C pay lines.

The player is now ready to play Round 9 of game play in accordance with the teaching of the invention. After selecting a number of hands to play the player touches Deal button 13 to start Round 9 of game play. Thereafter, the player touches another of the remaining fifteen display positions in an attempt to find the remaining Bonus C bonus number. The player this time picks the matrix position with the Bonus C number "18" behind the shamrock. This is indicated by the "C" in the Bonus Hit column in the ninth row (Round 9) of the table in FIG. 25. The player initially selected "6" pay lines as described above, and with the "18" bonus pay lines the player now has a total "24" pay lines for determining winnings at the end of the ninth round of game play. This is reflected in the last column of the ninth row of the table, entitled "Total Pay Lines", which reads "24".

At the end of Round 9 of game play the number of bonus pay lines for Bonus A through Bonus C is incremented by two. The Bonus C pay lines were decremented to zero when the player won them in the ninth round (Round 9) of game play, but the number is incremented by two going into Round 10, so "2" shows under Bonus C Pay Lines for Round 10. The number of Bonus A pay lines is incremented to "8", and the number of Bonus B pay lines is incremented to "12".

The player having found all three bonus pay lines during the nine rounds of game play described above per the teaching of the invention the game software now replaces all shamrocks on the display matrix, and selects three new positions for the Bonus A through Bonus C pay line numbers. The difference is that the number of bonus pay lines may or may not be reset to a default number of "2". In the description herein, after the reset described above the player has the number of Bonus A through Bonus C pay lines shown for Round 10 in the last row of the table shown in FIG. 25.

While what has been described hereinabove is a preferred embodiment of the invention, those skilled in the art will understand that numerous changes may be made without departing from the spirit and scope of the invention. For example, sets of rules have been described governing how pay lines zig-zag through the matrix, but these rules may be changed while still having the dynamic pay lines of the present invention.

The invention claimed is:

1. A method for dynamically determining a number of pay lines to be used during game play of a game of chance having a matrix of rows and columns of positions in which are displayed game play indicia, pay lines are used to indicate winning combinations of the game play indicia displayed in the matrix, where a number of pay lines are initially selected and bets placed thereon by the player before the start of a round of game play, and the method comprising the steps of:

(a) randomly selecting a predetermined number of positions in the matrix of the game of chance being played and associating a number of bonus pay lines with each of the randomly selected predetermined number of positions;

(b) dealing game play indicia into all positions in the matrix when the player initiates start of game play;

(c) the player selecting one of the positions in the matrix of the game of chance being played in an attempt to locate one of the predetermined number of positions randomly selected in step (a) to have a number of bonus pay lines associated therewith, the player receiving the associated number of bonus pay lines for the game of chance being played when the position they have selected is one of those randomly selected in step (a;

(d) determining the player's winnings for the game of chance being played by analyzing the game play indicia along each of the number of pay lines initially selected by the player and along any bonus pay lines in the game of chance being played and received by the player when they select one of the predetermined number of positions;

(e) incrementing the number of bonus pay lines associated with each of the predetermined number of positions of step (a) that has not been located by the player in step (c); and (f) repeating steps (b) through (e) until the player has selected all of the predetermined number of positions of step (a) in step (c) and has received the bonus pay lines associated therewith.

2. The method for dynamically determining a number of pay lines of claim 1 further comprising the step:

(g) randomly selecting a new predetermined number of positions in the matrix and associating therewith a number of bonus pay lines in step (a) after the player has selected all of the predetermined number of positions and received the bonus pay lines associated therewith in step (f); and (h) repeating steps (b) through (e) until the player has selected all of the new predetermined number of positions per step (g) and received the bonus pay lines associated therewith.

3. The method for dynamically determining a number of pay lines of claim 2 further comprising the step of:

(i) routing bonus pay lines through the one of the predetermined number of positions selected by the player and with which the last mentioned bonus pay lines are associated.

4. The method for dynamically determining a number of pay lines of claim 2 further comprising the step of:

(g) marking each position in the matrix selected by the player in step (c) until all the predetermined number of positions in the matrix randomly selected in step (a) have been selected.

5. The method for dynamically determining a number of pay lines of claim 1 further comprising the step of:

(g) routing bonus pay lines through the one of the predetermined number of positions selected by the player and with which the last mentioned bonus pay lines are associated in step (a).

6. The method for dynamically determining a number of pay lines of claim 1 further comprising the step of:

(g) marking each position in the matrix selected by the player in step (c) until all the predetermined number of positions in the matrix randomly selected in step (a) have been selected.

7. The method for dynamically determining a number of pay lines of claim 5 further comprising the step of:

(h) marking each position in the matrix selected by the player in step (c) until all the predetermined number of positions in the matrix randomly selected in step (a) have been selected.

* * * * *